US009250000B2

(12) United States Patent
Rosenfeld

(10) Patent No.: US 9,250,000 B2
(45) Date of Patent: Feb. 2, 2016

(54) TECHNIQUES FOR INDIRECT COLD TEMPERATURE THERMAL ENERGY STORAGE

(76) Inventor: Matthew Rosenfeld, Pleasantville, NY (US)

( * ) Notice: Subject to any disclaimer, the term of this patent is extended or adjusted under 35 U.S.C. 154(b) by 0 days.

(21) Appl. No.: 13/187,829

(22) Filed: Jul. 21, 2011

(65) Prior Publication Data

US 2012/0047891 A1 Mar. 1, 2012

Related U.S. Application Data

(60) Provisional application No. 61/400,187, filed on Jul. 24, 2010.

(51) Int. Cl.
*F01K 3/00* (2006.01)
*F01K 1/02* (2006.01)
*F25B 25/00* (2006.01)

(52) U.S. Cl.
CPC ..... *F25B 25/00* (2013.01); *Y10T 29/49716* (2015.01)

(58) Field of Classification Search
CPC ..... F25B 25/00; F25B 29/00
USPC ..... 60/527, 39.18, 9.182, 649, 673, 728, 60/652
See application file for complete search history.

(56) References Cited

U.S. PATENT DOCUMENTS 4,144,723 A 3/1979 Morse et al.
4,302,944 A * 12/1981 Gainer ..... 62/59
4,571,947 A * 2/1986 Bronicki ..... 60/641.8
4,986,956 A 1/1991 Garabedian
5,431,016 A * 7/1995 Simpkin ..... 60/650
5,572,883 A * 11/1996 Roberts ..... 62/434
5,632,148 A 5/1997 Bronicki et al.
5,782,093 A 7/1998 Yamashita et al.
6,422,019 B1 * 7/2002 Bronicki et al. ..... 60/728
6,880,343 B2 * 4/2005 Kopko ..... 60/772
6,996,988 B1 * 2/2006 Bussard ..... 60/641.8

(Continued)

FOREIGN PATENT DOCUMENTS

DE EP1861595 * 12/2007 ..... F01P 3/20

OTHER PUBLICATIONS

Espacenet English by Machine Translation EP1861595 A1 Dec. 5, 2007.*

(Continued)

*Primary Examiner* — Kenneth Bomberg
*Assistant Examiner* — Deming Wan
(74) *Attorney, Agent, or Firm* — Otterstedt, Ellenbogen & Kammer, LLP

(57) ABSTRACT

During off-peak operation of a power plant operating on a thermodynamic cycle wherein heat is rejected to an ambient fluid, heat is removed from a cold temperature storage medium. The cold temperature storage medium is stored until the power plant is experiencing a peak period. During the peak period, the stored cold temperature storage medium is used to absorb heat from the ambient fluid prior to heat rejection from the thermodynamic cycle to the ambient fluid, to improve performance of the thermodynamic cycle. In another aspect, the stored cold temperature storage medium is mixed with the ambient fluid prior to heat rejection from the thermodynamic cycle to the ambient fluid. Corresponding systems, apparatuses, retrofit methods, design and control techniques are also disclosed.

24 Claims, 7 Drawing Sheets

(56) References Cited

U.S. PATENT DOCUMENTS

| | | | | |
|---|---|---|---|---|
| 8,074,461 | B2 | 12/2011 | McKenna | |
| 2002/0077728 | A1 | 6/2002 | Fukuda et al. | |
| 2002/0189277 | A1* | 12/2002 | Takao et al. | 62/430 |
| 2004/0020206 | A1* | 2/2004 | Sullivan et al. | 60/670 |
| 2006/0248910 | A1* | 11/2006 | Smolko et al. | 62/315 |
| 2009/0179429 | A1 | 7/2009 | Ellis et al. | |
| 2010/0064682 | A1* | 3/2010 | Kamen et al. | 60/526 |
| 2013/0086904 | A1* | 4/2013 | Bent et al. | 60/641.8 |

OTHER PUBLICATIONS

Felipe R. Ponce Arrieta, Electo E. Silva Lora, Influence of ambient temperature on combined-cycle power-plant performance, Applied Energy, vol. 80, No. 3, 261-272, 2005, Available on-line Jun. 7, 2004.

World Nuclear Association, "Cooling power plants," Apr. 2011, pp. 1-14.

Wikipedia, "Phase-change material," downloaded from http://en.wikipedia.org/wiki/Phase_change_material on Jan. 23, 2011, pp. 1-8.

Engineers Edge, LLC, Large Steam System Condensers, downloaded from http://www.engineersedge.com/heat_exchanger/large_steam_condenser.htm on Jan. 23, 2011, pp. 1-2.

Greenway Design Group, Inc., Cool-n-Save—How Does it Work, downloaded from http://www.coolnsave.com/index.php/How-Does-it-Work.html on Oct. 7, 2013, pp. 1-2.

ISA/US, International Search Report and Written Opinion of the ISA, International Application No. PCT/US11/44816, Dec. 22, 2011, pp. 1-14.

* cited by examiner

TECHNIQUES FOR INDIRECT COLD TEMPERATURE THERMAL ENERGY STORAGE

CROSS-REFERENCE TO RELATED APPLICATION(S)

This application claims the benefit of U.S. Provisional Application Ser. No. 61/400,187, filed on Jul. 24, 2010, the complete disclosure of which is expressly incorporated herein by reference in its entirety for all purposes.

FIELD OF THE INVENTION

The present invention relates to the mechanical arts, and, more particularly, to thermodynamic aspects of power plants and the like.

BACKGROUND OF THE INVENTION

It is a well established fact that power plants perform better when ambient conditions allow for colder than normal condenser operation; cooler condenser temperatures allow for lower condenser pressures which together lead to greater power generation and thermodynamic efficiency. In fact, in certain circumstances this effect can be quite significant. Arrieta and Lora, in their paper "Influence of Ambient Temperature on Combined-Cycle Power-Plant Performance," Applied Energy 80 (2005) 261-272, indicate that ambient conditions at or near freezing can lead to an 8.3% increase in net power generation compared to design conditions and up to a 16.7% increase in net power generation compared to hot temperature conditions.

Large regular swings in electricity demand between low load hours and peak load hours necessitate techniques for storing energy. There are currently only a few utility-scale energy storage technologies in existence; the most popular being pumped storage technology in which water is pumped up a hill during off-peak hours and run down like a hydroelectric plant during peak hours. Geographically, pumped storage has already reached its limits. Currently, to deal with the lack of storage options and the large differences in regular demand, small "peak loading" power plants are built. These power plants have the ability to turn on and off quickly, but operate only a few hours a day, so that they need to charge significantly higher rates for the electricity they produce.

Thermal energy storage concepts have been around for quite some time and a great deal of research continues in this area. Most commonly in power generation settings, thermal energy storage relies on heat stored in a substance at high temperature and insulated until it is desired to move heat from that high temperature substance to a working fluid. For example, in many solar thermal power plants, synthetic salts absorb heat energy during the daytime, and are used as a heat source to generate steam at night. These salts may also incorporate a phase transition between molten and solid states to increase their energy storage potential. Alternatives on this approach have been proposed such as Ellis et al. in their U.S. Patent Publication 2009-0179429, but they are still essentially similar in that storage technologies such as these are meant to be capable of running an entire power cycle without any assistance when they need to be called upon.

Hot temperature storage technologies are appropriate for situations like solar thermal plants where, without such energy storage options, the plant would be unable to operate at all during the night time. However, it is believed that such storage technologies are impractical for saving off-peak energy for peak hour consumption on a large scale. The reason for this is that in order to convert the heat energy stored in the medium into electricity, a dedicated set of power plant equipment is needed (i.e., a turbine, condenser, pumps, and the like). Along the same line of reasoning, the reason why hot temperature storage methods work for solar thermal plants is that without the storage system, the remainder of the plant equipment would be idle during night time. In the case of a fossil fuel fired power plant that runs twenty four hours a day, an additional power plant would have to be constructed to handle the stored energy.

Thermal energy storage can also come in the form of low temperature storage technologies. The most common low temperature storage systems involve creating ice or some higher temperature ice alternative during off-peak hours, and using the ice for air conditioning during peak hours instead of running a chiller. These systems are widely used in commercial settings but they are limited in their use. They are only used to supply cooling for air conditioning purposes, not for generation of electricity using a heat engine operating on a thermodynamic cycle.

SUMMARY OF THE INVENTION

Principles of the invention provide techniques for indirect cold temperature thermal energy storage. In one aspect, an exemplary method includes the steps of during off-peak operation of a power plant operating on a thermodynamic cycle wherein heat is rejected to an ambient fluid, removing heat from a cold temperature storage medium; storing the cold temperature storage medium until the power plant is experiencing a peak period; and, during the peak period, using the stored cold temperature storage medium to absorb heat from the ambient fluid prior to heat rejection from the thermodynamic cycle to the ambient fluid, to improve performance of the thermodynamic cycle.

In another aspect, another exemplary method includes the steps of during off-peak operation of a power plant operating on a thermodynamic cycle wherein heat is rejected to an ambient fluid, removing heat from a cold temperature storage medium; storing the cold temperature storage medium until the power plant is experiencing a peak period; and during the peak period, mixing the stored cold temperature storage medium with the ambient fluid to lower temperature of the ambient fluid prior to heat rejection from the thermodynamic cycle to the ambient fluid, to improve performance of the thermodynamic cycle.

In still another aspect, an exemplary system, according to an aspect of the invention, includes a power plant operating on a thermodynamic cycle wherein heat is rejected to an ambient fluid; a cold temperature storage medium storage unit; a refrigeration arrangement configured to remove heat from cold temperature storage medium stored in the cold temperature storage medium storage unit during off-peak operation of the power plant; and a heat exchanger configured to cause, during peak operation of the power plant, the stored cold temperature storage medium to absorb heat from the ambient fluid prior to heat rejection from the thermodynamic cycle to the ambient fluid, to improve performance of the thermodynamic cycle.

In an even further aspect, another exemplary system, includes a power plant operating on a thermodynamic cycle wherein heat is rejected to an ambient fluid; a cold temperature storage medium storage unit; a refrigeration arrangement configured to remove heat from cold temperature storage medium stored in the cold temperature storage medium storage unit during off-peak operation of the power plant; and a mixing unit configured to cause, during peak operation of the power plant, the stored cold temperature storage medium to mix with the ambient fluid prior to heat rejection from the thermodynamic cycle to the ambient fluid, to improve performance of the thermodynamic cycle.

In yet a further aspect, an exemplary method is provided for retrofitting a power plant operating on a thermodynamic cycle wherein heat is rejected to an ambient fluid with an indirect cold temperature thermal energy storage system for peak conditions. The method includes the steps of: providing a cold temperature storage medium storage unit; providing a refrigeration arrangement configured to remove heat from cold temperature storage medium stored in the cold temperature storage medium storage unit during off-peak operation of the power plant; and providing a heat exchanger configured to cause, during peak operation of the power plant, the stored cold temperature storage medium to absorb heat from the ambient fluid prior to heat rejection from the thermodynamic cycle to the ambient fluid, to improve performance of the thermodynamic cycle.

In a still further aspect, an exemplary method is provided for retrofitting a power plant operating on a thermodynamic cycle wherein heat is rejected to an ambient fluid with an indirect cold temperature thermal energy storage system for peak conditions. The method includes the steps of: providing a cold temperature storage medium storage unit; providing a refrigeration arrangement configured to remove heat from cold temperature storage medium stored in the cold temperature storage medium storage unit during off-peak operation of the power plant; and providing a mixing unit configured to cause, during peak operation of the power plant, the stored cold temperature storage medium to mix with the ambient fluid prior to heat rejection from the thermodynamic cycle to the ambient fluid, to improve performance of the thermodynamic cycle.

Also provided are apparatuses including means to carry out the methods disclosed herein.

As used herein, "facilitating" an action includes performing the action, making the action easier, helping to carry the action out, or causing the action to be performed. Thus, by way of example and not limitation, instructions executing on a processor might facilitate an action carried out by a mechanical device such as a valve or the like, by sending appropriate data or commands to cause or aid the action to be performed. For the avoidance of doubt, where an actor facilitates an action by other than performing the action, the action is nevertheless performed by some entity or combination of entities.

One or more embodiments of the invention or elements thereof can be implemented in the form of a computer program product including a tangible computer readable recordable storage medium with computer usable program code for performing the method steps indicated. Furthermore, one or more embodiments of the invention or elements thereof can be implemented in the form of a system (or apparatus) including a memory, and at least one processor that is coupled to the memory and operative to perform exemplary method steps. Yet further, in another aspect, one or more embodiments of the invention or elements thereof can be implemented in the form of means for carrying out one or more of the method steps described herein; the means can include (i) hardware module(s), (ii) software module(s) stored in a tangible computer readable storage medium (or multiple such media) and implemented on a hardware processor, or (iii) a combination of (i) and (ii); any of (i)-(iii) implement the specific techniques set forth herein. Non-limiting examples of aspects of the invention that may be implemented in accordance with this paragraph include computer control of a power plants or portions thereof, as well as computer-aided design of new and/or retrofit installations.

Techniques of the present invention can provide substantial beneficial technical effects. For example, one or more embodiments may provide one or more of the following advantages:

- At least some embodiments of a "capsule" approach provide more efficient heat transfer, potentially allowing for a faster and/or less expensive discharge system; such approaches may be appropriate where the concomitant loss of evaporative effects and reduced energy density can be tolerated.
- At least some "stored vacuum" embodiments can shift some of the fan requirements to off peak periods; while this increases the amount of energy required to charge the system, it also increases the net power boost during discharge.
- Some embodiments can be used instead of backup cooling towers in situations where the cooling water supply source naturally approaches environmental law limits. In such instances one or more embodiments of an energy storage system in accordance with aspects of the invention are believed to be preferable to the two existing options of using backup cooling towers and reducing power output. Backup cooling towers rarely allow for the same level of power output as the water cooled system; one or more embodiments of an energy storage system in accordance with aspects of the invention allow the plant to operate at greater than full capacity during discharge. For example, in mid-2010 at the Browns Ferry Nuclear Power Plant in Alabama, high river water temperatures forced the power plant to operate at just 50% capacity for several weeks costing about $50 million to rate payers.
- One or more embodiments are particularly beneficial in warmer climates where cooling water temperatures naturally never reach cool temperatures and air temperatures are consistently high or mild.
- One or more embodiments exhibit an increased benefit in power plants that employ cooling towers with closed loop cooling water systems. The water in these closed loop cooling systems is usually maintained at a higher temperature than most river, lake, or sea water in similar climates; so reducing the water temperature in a closed loop system can lead to relatively large power boosts. Additionally, depending upon plant design, the cooling towers themselves may be able to provide the negative pressure required to realize evaporative effects for the cold temperature storage material (CTSM), thus saving on the installation cost.
- One or more embodiments have significant benefits over existing energy storage systems such as compressed air storage (CAS), pumped hydro storage, and batteries. One or more embodiments do not have any geographical or environmental constraints like CAS and pumped hydro systems have. One or more embodiments can be installed as a retrofit to an existing power plant; in at least some instances, this can potentially save on electrical transmission equipment, permitting, and contractual expenses. One or more embodiments should have a significantly greater life expectancy and lower cost than any existing battery technology. One or more embodiments are quire versatile and capable of being put in place at almost any steam cycle power plant, new or existing, regardless of location.

These and other features and advantages of the present invention will become apparent from the following detailed description of illustrative embodiments thereof, which is to be read in connection with the accompanying drawings.

DETAILED DESCRIPTION OF PREFERRED EMBODIMENTS

Figure 1:
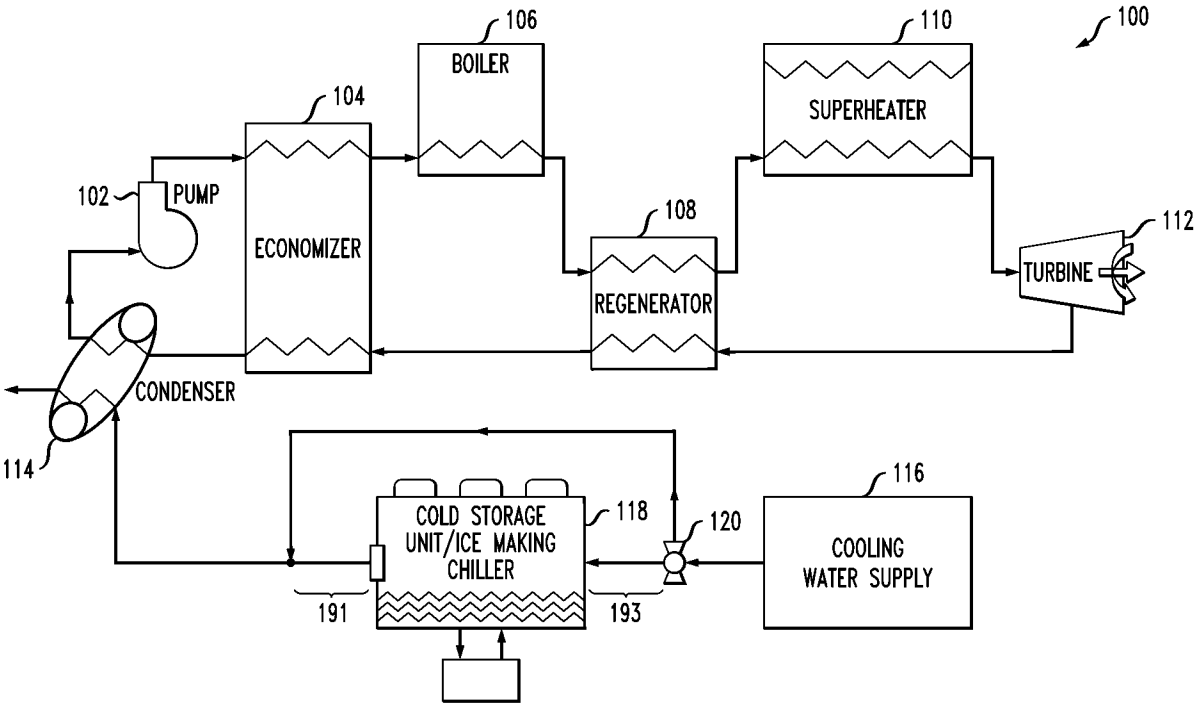
FIG. 1 shows a simplified flow diagram in a Rankine system application, according to an aspect of the invention.

As noted, it is a well established fact that power plants perform better when ambient conditions allow for colder than normal condenser operation; cooler condenser temperatures allow for lower condenser pressures which together lead to greater power generation and thermodynamic efficiency. In fact, in certain circumstances this effect can be quite significant. Arrieta and Lora, in their paper "Influence of Ambient Temperature on Combined-Cycle Power-Plant Performance," Applied Energy 80 (2005) 261-272, indicate that ambient conditions at or near freezing can lead to an 8.3% increase in net power generation compared to design conditions and up to a 16.7% increase in net power generation compared to hot temperature conditions.

Any considerations of artificially reducing the temperature of the cooling air or cooling water using some type of refrigeration or chiller device to increase power generation capacity run afoul of the laws of thermodynamics, which ensure that the amount of energy expended to reduce the condenser temperature and pressure will be greater than the boost in power generation. However, one or more embodiments use this effect for energy storage. Any energy storage system will have losses; any time a battery is charged, for example, the amount of energy used to charge that battery is inevitably greater than the amount of energy that can be usefully withdrawn from the battery. In the case of batteries, the benefit of having portable electronic devices far outweighs the price in energy losses and can justify the relatively high price per kWh of energy stored that batteries often cost.

One or more embodiments provide a low temperature storage technology that operates by improving the performance of conventional steam driven power plants during peak hours of operation. One or more embodiments work by effectively storing energy by cooling a cold temperature storage medium during off-peak conditions and then using the cooled cold temperature storage medium to allow heat rejection from a thermodynamic cycle at a lower temperature than would otherwise be feasible, during peak conditions. In particular, in some cases, during off-peak hours, ice or some other low temperature phase change material is frozen. In this context, "low temperature" means a temperature such that in the charged or frozen state, the temperature is sufficiently lower than that of the condenser cooling water supply, such that the net economic benefit of cooling the condenser cooling water outweighs the associated costs (e.g., running pumps, chiller, and so on). Then, the cold substance is used to cool the condenser water of a steam plant to improve its power output. Note that a phase change need not be employed in every instance. Since the power output from a turbine is directly proportional to the change in enthalpy through the turbine, and since, if the turbine rejects heat at a lower temperature then the output steam will have a lower enthalpy, then the overall change in enthalpy will be higher such that more power is obtained from the turbine. The skilled artisan will also appreciate that, due to second law considerations, the best efficiency that can be obtained by any cycle is the Carnot efficiency given by $1-T_L/T_H$; lowering $T_L$, the heat rejection temperature, by cooling the condenser water increases the Carnot efficiency and thus the maximum potential efficiency. $T_H$ is of course the temperature at which heat is added.

In one or more embodiments, energy is used during periods of low demand to produce one or more of water ice, an ice slurry, or an alternative low temperature phase change material. Optionally, energy can also be used during periods of low demand to create a separate vacuum chamber situated near the cold storage unit. A heat exchange system preferably connects the cold storage unit to the power plant's cooling loop. During periods of high demand, the power plant's cooling water is run through the heat exchange loop and significantly cooled down by the cold storage unit. Lower temperature cooling water allows the plant to utilize a lower bottom temperature and pressure in its steam cycle; this, in turn, will allow for greater performance.

In one or more embodiments, the cold storage system is only bringing down the temperature of the existing cooling water rather than acting as an independent heat sink. This way, in one or more embodiments, minus some inherent inefficiencies in the system, the cold storage unit is only saving the energy required to improve the existing cycle. A major advantage of such embodiments is, in a retrofit case, the system can be installed with minimum disturbance to the host power plant. This point can be illustrated by comparison to a system where the ice is used to directly condense the steam as opposed to cooling down existing condenser water. Note that in some instances the ice or other CTSM can be used to directly cool the condenser or can be physically mixed with the condenser water. As heat is added to the cold storage tank by the cooling water, the ice in the tank will undergo a phase transition at constant temperature. This will allow the tank to absorb a great deal of heat per unit mass of coolant before the temperature is affected. Once the ice has melted, the cold storage unit can be evacuated using a stored vacuum in a dedicated vacuum chamber. The cold storage unit's pressure will be reduced to encourage evaporation. As heat continues to be transferred to the unit from the power plant's cooling water, the fluid in the cold storage unit will begin to evaporate, once again at constant temperature.

Furthermore with regard to the mixing embodiment, as noted, in some instances, the CTSM storage chamber is used as a condenser; that is to say, one or more embodiments involve physically combining the CTSM directly with the cooling water. In this aspect, sufficient mixing is preferred to bring the average temperature of the cooling water mixture to whatever the design requirements are during discharge. Furthermore, in such embodiments, water ice is the preferred CTSM to avoid contamination of natural water supplies. Such embodiments may present cost reductions by minimizing the amount of new heat exchangers needed. One or more embodiments taking this approach behave exactly and look exactly like the systems presented in the flow charts provided elsewhere herein but the heat exchange system is be open instead of closed.

By way of a non-limiting example, consider a cold storage unit filled with water and a power plant that uses 30° C. water from a river as its cooling water to run the condenser. This 30° C. water allows for a bottom temperature and pressure of approximately 40° C. and 8 kPa. During off-peak hours of operation, a chiller or refrigeration device is run to convert the water in the cold storage unit to an ice slurry at 0° C. Additional energy is used during off-peak hours to run a vacuum pump to evacuate the dedicated vacuum chamber. During peak hours of operation the cooling water is sent through a heat exchanger that is in contact with the cold storage unit; heat is removed from the cooling water to reduce its temperature to 5° C. such that the power cycle can operate with a bottom temperature and pressure of 15° C. and 2 kPa. The ice can absorb about 334 kJ/kg before melting. Once the ice has melted, or nearly melted, the cold storage unit's pressure will be reduced using the stored vacuum chamber. As heat is added to the cold storage unit, a phase change from liquid to vapor will commence, which for low temperature water, will take approximately 2,500 kJ for every kg of ice evaporated. If 50% of the ice evaporates then about 1,584 kJ/kg of energy is stored by the system.

Embodiments of the storage system disclosed herein should not be confused with "condenser misting." Condenser misting is the process by which a fine mist of water is sprayed on a condenser, often accompanied with a fan system, to increase the quantity of heat that can be removed by the condenser. While this process does increase the amount of power a power plant can effectively generate, it does so at the cost of additional fuel; since the condensing temperature is not affected, it does not increase the efficiency of the power plant. However, one or more embodiments disclosed herein could, if desired, be used in conjunction with condenser misting.

Reference should now be had to FIG. 1, which depicts an exemplary system 100, according to an aspect of the invention. Conventional Rankine cycle operation will be described first. Subcooled liquid at low pressure enters pump 102 where it is raised to high pressure. The high pressure liquid enters economizer 104 where it is pre-heated by the turbine outlet steam, as will be discussed further below, and the warmer subcooled liquid, heated by the economizer, enters the boiler 106. In the boiler, the liquid evaporates and turns to saturated steam. It then passes through the regenerator 108 where it absorbs additional heat from the turbine outlet steam, as will be discussed further below, and finally enters superheater 110 where it is heated so as to pass from a saturated to a superheated state.

Figure 9:
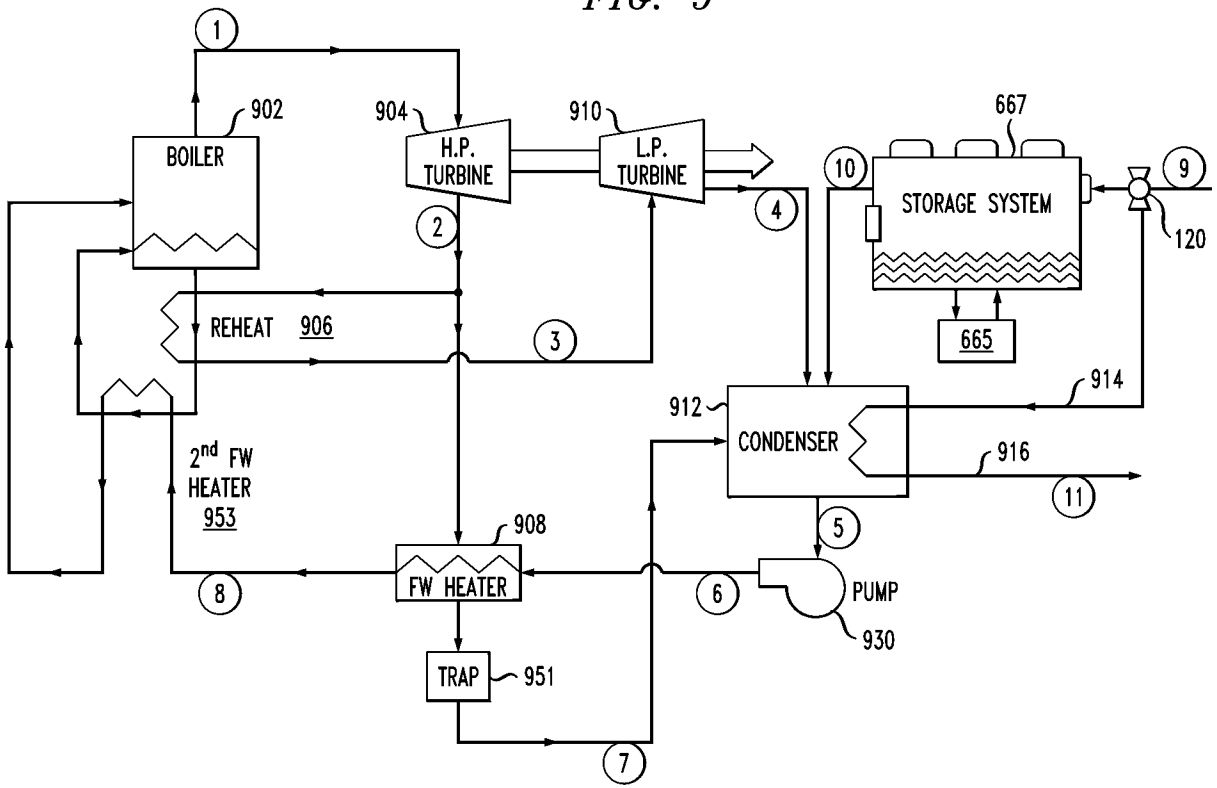
FIG. 9 shows an exemplary system schematic, according to an aspect of the invention.

The superheated steam then enters turbine 112 which is used to drive an electrical generator or the like. Note that only a single turbine stage is shown to avoid cluttering the drawings; many utility installations employ multiple turbine stages as shown in FIG. 9 below. The stage illustrated in the drawings is illustrative of a single stage system or the last stage of a multi-stage system, which is connected to the condenser. Note that other work-producing devices, such as a piston steam engine having a single or multiple expansion stages, could be used in other embodiments. The outlet steam, now at low pressure, then passes through regenerator 108 to provide additional heat to the outlet steam from the boiler 106, and through the economizer 104. Note that the working fluid at the output of most modern turbines is typically at less than 100% quality. The working fluid from the economizer then enters the condenser 114 where it condenses to a saturated liquid, and is further subcooled prior to being fed to the pump 102.

The skilled artisan will of course appreciate that the economizer and regenerator are heat exchangers wherein the high pressure side and low pressure side streams of working fluid (typically steam) exchange heat but do not mix; and that the high pressure side working fluid is heated in the boiler and superheater by combustion gasses, nuclear energy, or the like. Furthermore, in the condenser 114, the working fluid is cooled and condensed by cooling water 116 or the like (e.g., a river or other source of cooling water). Again, of course, the combustion gases and the cooling water exchange heat with, but do not physically mix with, the working fluid in the Rankine cycle. It is believed that one or more embodiments are particularly applicable to installations that employ river or lake water or the like for condenser cooling. However, some embodiments could be employed with cooling towers; for example, a bath of water located at the base of the cooling tower (and used to spray the tower) could be cooled using aspects of the invention.

In one or more embodiments of the invention, in addition to the aforementioned conventional components, a cold storage unit and ice making chiller, together designated generally as 118, are provided. One or more conventional commercial ice making chillers can be employed. Given the teachings herein, the skilled artisan will be able to size and specify appropriate commercial ice making chiller equipment to implement one or more embodiments of the invention. The cold storage or bulk storage component includes, in one or more embodiments, a large container or building that is well insulated and capable of storing ice produced by the ice making chiller.

During an off-peak condition, valve 120 routes cooling water around unit 118 and directly to condenser 114. The excess capacity during the off-peak condition is used to power the ice making chiller and prepare a supply of ice for use during peak conditions (in the general case, energy to run the chiller may come from the plant itself or be obtained externally). During a peak condition, the valve 120 routes cooling water through unit 118, where it is cooled below the temperature it would otherwise be at (say, below the temperature of the river water) and this additionally-cooled water is provided to condenser 114, where it allows heat rejection from the Rankine cycle at a lower temperature (and lower pressure), thereby raising the thermodynamic efficiency of the cycle and the effective generating capacity of the plant.

In one or more embodiments, the system stores ice for potentially long periods of time in an insulated setting and when needed (peak load periods, e.g.), puts the ice in contact with a heat exchanger or heat exchange material such that heat from the cooling water can be transferred to the ice, thereby cooling the cooling water below its initial temperature before sending it to the condenser. In order to address both of these aspects, several non-limiting exemplary embodiments are disclosed.

In a non-limiting exemplary embodiment designated as embodiment A, a large heat exchanger can be integrated into the bulk storage system. The heat exchanger has doors (e.g., gate valves in fluid terms) at all entrances and exits made of thick, insulating material, and equipped with actuators. When the system is producing or storing ice, the doors will remain closed. When the system is cooling the condenser water, the doors will open and pipes will be extended from the heat exchanger entrances and exits to the condenser water system or river and/or lake water system such that the cooling water can flow through the pipes and be put in contact with the ice. Fins can also be added to the pipes to optimize the heat exchange effectiveness of the system.

In another non-limiting exemplary embodiment designated as embodiment B (see, e.g., FIG. 8), heat exchange storage units include small, insulated capsules 888 that each contain a small amount of ice or other CTSM (small relative to the entire system's storage capacity). The bulk ice storage container 886 will include a large, insulated container filled with these smaller capsules 888. During discharge, condenser water is allowed to flow between the capsules such that heat from the condenser water can be transferred to the capsules (see FIG. 8).

The high surface area to volume ratio of this approach could allow for quick and effective heat exchange with the condenser water. However, since the capsules would have to be sealed, evaporative cooling would not be realistic. As always, care should be taken in the design to avoid locally freezing the condenser water.

Embodiment A is highly scalable and allows for greater overall energy density from evaporative cooling effects. Embodiment B can allow for fast heat transfer rates and eliminates the need for heat exchanger piping and fins.

One or more embodiments advantageously provide a low-cost per kWh, efficient, effective system that can be installed as either a component on a new power plant or as an upgrade to an existing power plant.

In more general terms, an embodiment of the invention may include a cold temperature storage medium (CTSM) charging system, a CTSM storage and heat exchange system, a controls system, and a discharge system. The CTSM charging system may include the aforementioned ice making chiller or other ice making apparatus connected to a source of water or other CTSM to be frozen. In one or more embodiments, the CTSM supply source includes a tank or pool, or if water is being used as the CTSM, then any water source capable of handling the necessary volume (e.g., river, lake). The CTSM can be considered to be in a "charged" state when it is in a solid or slurry phase and/or at a temperature below the condenser water temperature; the CTSM can be considered "discharged" when, given the installed heat exchange system, the temperature difference between the CTSM and the condenser water is no longer sufficient enough to cool the condenser water enough to provide a justifiable increase in plant power production. The entire storage system can be open or closed, though a closed system will be preferable in most cases to minimize filtration requirements.

In one or more embodiments, the cold temperature storage medium charging system, storage and heat exchange system, and discharge systems are all interconnected; after the CTSM is charged it is stored in the storage and heat exchange system. An embodiment of the invention includes a CTSM that is a slurry material that can be pumped into the storage and heat exchange system (see discussion of FIG. 3 below); an alternative embodiment includes a CTSM charging system that is located within the storage and heat exchange system such that the CTSM need not be transported after charging (see discussion of FIG. 5 below). The CTSM storage and heat exchange system serves to store the CTSM with minimal heat losses to the ambient environment so as to keep the CTSM in a charged state for as long as possible; during discharge, the CTSM storage and heat exchange system allows for heat transfer to take place between the cooling water and the CTSM.

An embodiment of the CTSM storage and heat exchange system may include, for example, a multilayered insulated structure 118 with heat exchanger piping 673 and fins optimally placed inside, and insulated valves or doorways (as noted, in fluid terms, equal to gate valves) connecting the piping within the storage and heat exchange system to cooling water piping (stated another way, adequate thermal isolation is preferably provided for the unit 667—for example, the piping can be thermally isolated by using low thermal conductivity pipe sections for connection, with high thermal conductivity materials within the chamber 667 where efficient heat transfer is desired). The CTSM storage and heat exchange system may also allow for "free cooling" during times when the outside air temperature is lower than that of the CTSM (see discussion of FIG. 6 below). Furthermore, one or more embodiments of the invention include additional storage tanks to add to total storage capacity. This can be done with a larger "ice room" or multiple "ice rooms." Note that the cycle of peak and off-peak demand need not be a daily cycle; the periodicity can be greater or less than one day.

In order for the system to discharge, in one or more embodiments, cooling water will be redirected from its normal path and flow through the pipes in the CTSM storage and heat exchange system (for example, bypass valve 120 directs cooling water to flow through unit 118 instead of bypassing same) such that heat exchange can take place between the CTSM and the cooling water.

Figure 6:
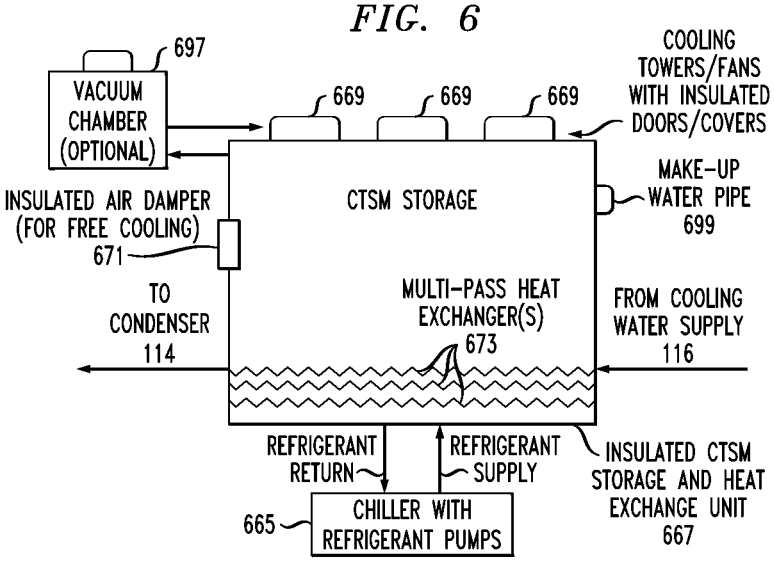
FIG. 6 shows a riser diagram, according to an aspect of the invention.

In some instances, referring to FIG. 6, one or more embodiments can include fans or cooling towers attached to the CTSM storage and heat exchange unit such that evaporative cooling effects can be encouraged. If this aspect is employed, there will typically be a tradeoff between fan power and the net power increase the energy system provides; the reason to increase the fan power would be to effectively increase the energy density (per unit mass or unit volume, e.g., BTU per pound mass/kJ per kilogram or BTU per cubic foot/kJ per cubic meter) of the CTSM which can help reduce the size of the charging equipment and storage tank. Note that the required increase in fan power must be taken into account and a determination made as to whether it outweighs the gain from evaporation. Note also that the increase in energy density arises due to the ability to take advantage of both the latent heat of fusion and the latent heat of vaporization when the evaporation takes place. This effectively keeps the CTSM at a low temperature for a longer time. Given this tradeoff and the teachings herein, the skilled artisan will be able to optimize the system for one or more applications.

Another aspect of the system that will typically benefit from optimization is the allowable temperature rise in the CTSM during discharge and at what temperature evaporation will take place (when the cooling towers are activated). To accommodate multiple temperature levels, some embodiments provide a dynamic heat exchange system in which the heat exchange area and/or effectiveness can be changed (e.g., by using or shutting off multiple passes or adding or removing insulation) to accommodate a change in the temperature difference between the CTSM and the cooling water. For example, if the CTSM is pure water ice in its charged state at 32° F. (0° C.), and the cooling water in the design case comes in at 75° F. (23.88° C.) and leaves the system at 45° F. (7.2° C.), initially, the discharge system could employ a single pass of copper or steel pipe with fins. While the ice melts when discharging, the temperature of the CTSM may be allowed to rise and undergo a partial phase transition with 10% of the CTSM evaporating. In order to accommodate this temperature rise while still cooling the cooling water to 45° F. (7.2° C.) a second heat exchange pass could be used.

In addition to its mechanical components, a controls system is also provided in one or more embodiments. The controls system could exist as an upgrade to an existing controls system or as a dedicated controls system that communicates with the existing controls system. The controls system monitors the temperature of the CTSM as well as the pressure in the CTSM storage unit so the operator can determine how "charged" the system is. The operator preferably can both manually control the flow of cooling water through the cold storage system using the controls system and use automated control of same. The controls system is also configured to calculate the necessary cooling water flow rate and make adjustments to it.

A potential benefit of one or more embodiments is that during discharge, the cooling water flow rate requirements typically decrease; this subsequently reduces the pump work requirements and therefore contributes to the net power increase during discharge. One reason why cooling water flow rates need to be so high in power plants in the United States is because of environmental laws regulating the allowable temperature rise in the cooling water. Since the invention lowers the cooling water temperature before it is used in the condenser, the temperature difference between the lowest cooling water temperature and the highest cooling water temperature can, in effect, be greater than the environmental regulation, since the outlet cooling water will be sufficiently cool to reduce or eliminate adverse environmental impact because of the reduced temperature of the inlet cooling water. This allows for lower cooling water flow rates and thus lower pump power requirements.

Figure 2:
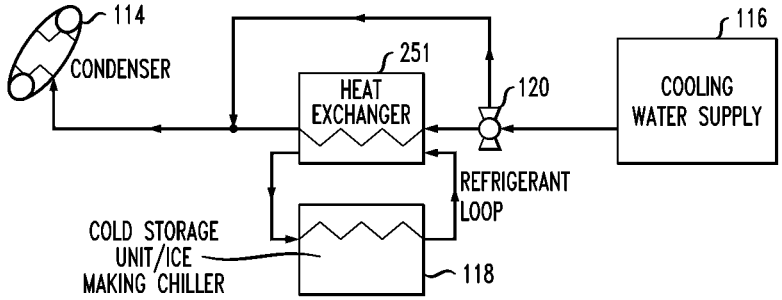
FIG. 2 shows an alternative flow diagram with a refrigerant loop, according to an aspect of the invention.

FIG. 2 shows a partial alternative flow diagram wherein elements similar to those in FIG. 1 are designated with the same reference character (omitted elements can be similar to those in FIG. 1, for example). Here, instead of cooling water passing through unit 118, unit 118 is provided with a closed loop of refrigerant fluid which passes through a heat exchanger 251 which cools the cooling water prior to its entry to the condenser 114. In one or more embodiments, the refrigerant loop is a pumped loop of glycol or the like and not a mechanical refrigeration cycle. One potential advantage of this type of design is the flexibility to manipulate the temperature by choice of refrigerant. In some instances, heat transfer between the CTSM and the refrigerant can be optimized to provide more compact and efficient heat transfer and reduce pumping power as compared to heat transfer between the CTSM and the condenser cooling water.

Figure 3:
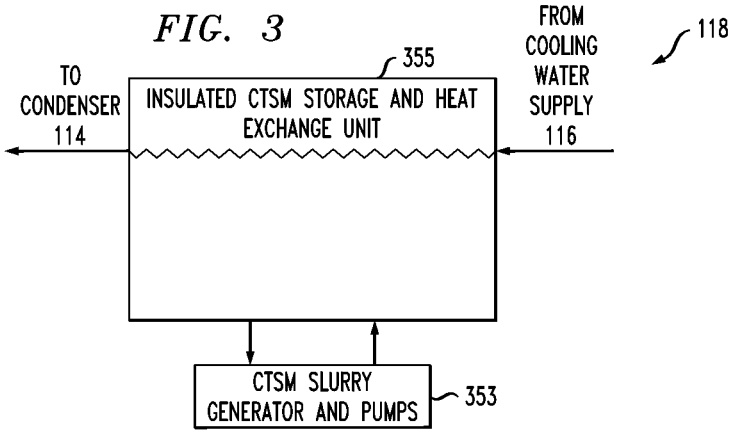
FIG. 3 shows cold temperature storage medium (CTSM) storage and generation units with a CTSM slurry flow diagram, according to an aspect of the invention.

FIG. 3 shows a cold temperature storage medium (CTSM) storage and generation unit with a CTSM slurry flow diagram. Elements similar to those in FIG. 1 are designated with the same reference character. Here, unit 118 is realized as a CTSM slurry generator with pumps (block 353) and an insulated CTSM storage and heat exchange unit 355. During off-peak conditions, the CTSM slurry is generated in unit 353 and pumped into storage unit 355, where it cools cooling supply water during subsequent peak demand conditions. In some instances, the ice-water slurry can be physically pumped through a heat exchanger in thermal communication with the condenser water.

Figure 10:
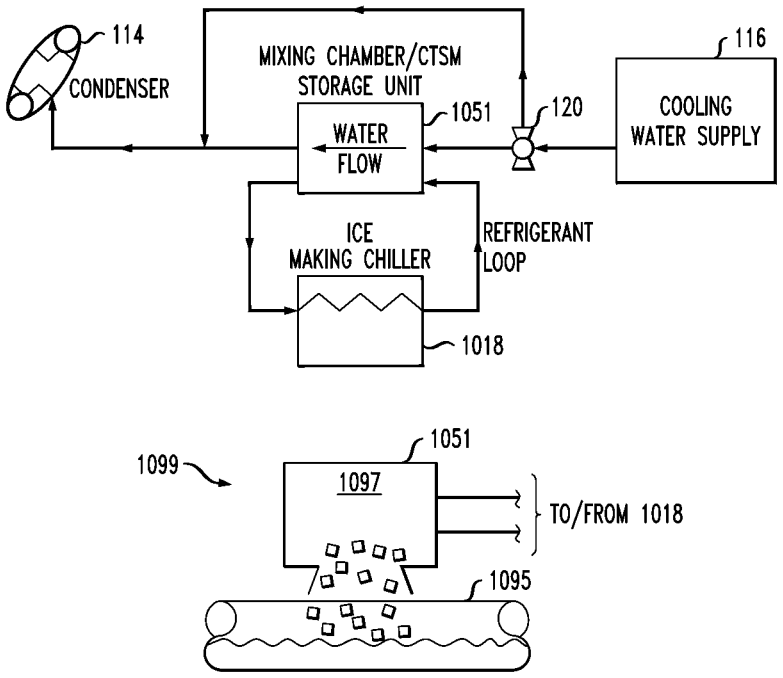
FIG. 10 shows an embodiment similar to FIG. 2, except with mixing of the CTSM and cooling water.

FIG. 10, discussed elsewhere herein, depicts a case where ice or other CTSM is introduced directly into the condenser cooling water.

Figure 11:
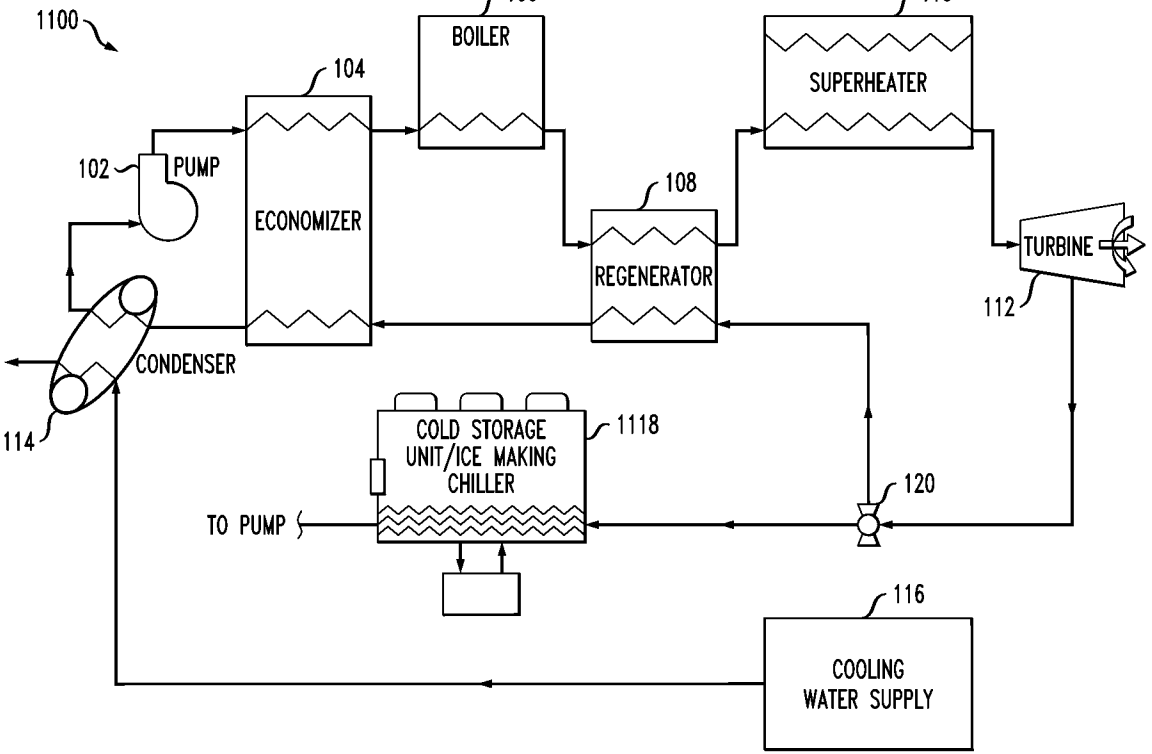
FIG. 11 shows an embodiment similar to FIG. 1 but where the CTSM storage unit serves as a condenser during peak mode.

FIG. 11 depicts a case 1100 where steam is sent directly through the cold storage chamber, bypassing the condenser. Elements similar to FIG. 1 have received the same reference character. As seen in the alternative approach of FIG. 11, rather than routing cooling water through the cold temperature storage system 1118, low pressure steam leaving the turbine 112 could be routed such that the cold temperature storage system acts as a condenser. Valve 120 switches between the charge and discharge states. Such an embodiment may be preferable in that less material will need to flow through the cold temperature storage unit.

Figure 4:
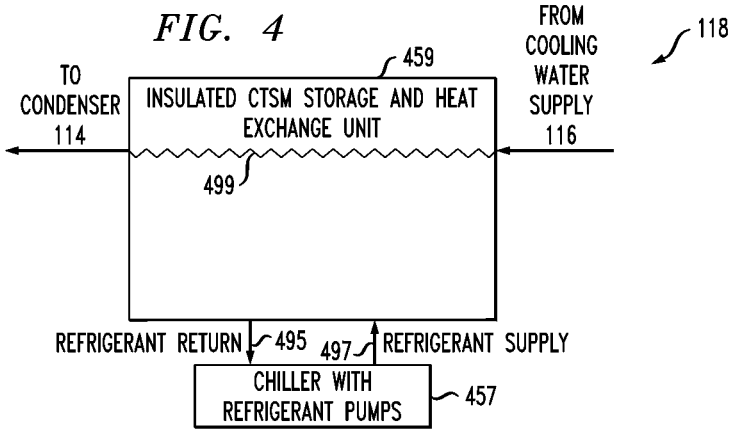
FIG. 4 shows CTSM storage and generation units with a refrigerant loop flow diagram, according to an aspect of the invention.

FIG. 4 shows CTSM storage and generation units with a refrigerant loop flow diagram. Elements similar to those in FIG. 1 are designated with the same reference character. Here, unit 118 is realized as a chiller with refrigerant pumps (block 457) and an insulated CTSM storage and heat exchange unit 459. During off-peak conditions, the chiller unit 457 pumps refrigerant into storage unit 459, where it cools CTSM (e.g., freezing ice). During subsequent peak demand conditions, cooling water is routed through unit 459 to cool it prior to its entry to the condenser 114. In this aspect, as opposed to one using an ice slurry capable of being pumped, a mechanical refrigeration cycle is thus used to freeze the ice.

Figure 5:
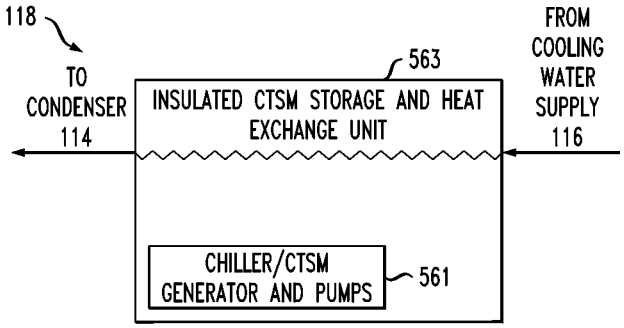
FIG. 5 shows CTSM storage and generation units with a flow diagram for a CTSM generator inside the insulated storage unit, according to an aspect of the invention.

FIG. 5 shows CTSM storage and generation units with a flow diagram for a CTSM generator inside the insulated storage unit. Elements similar to those in FIG. 1 are designated with the same reference character. Here, unit 118 is realized as a chiller and/or CTSM generator and pumps (block 561) inside the insulated CTSM storage and heat exchange unit 563. During off-peak conditions, the CTSM freezes ice or otherwise chills CTSM for storage inside unit 563. During subsequent peak demand conditions, cooling water is routed through unit 563 to cool it prior to its entry to the condenser 114. Thus, in some embodiments, move the mechanical refrigeration system into the cold storage are; for example, to enhance insulation and/or reduce undesirable heat transfer.

FIG. 6 shows a riser diagram, according to an aspect of the invention. Cooling towers 669 are provided to encourage evaporative effects in the CTSM and as a location for the condensers of chillers. Elements similar to those in FIG. 1 are designated with the same reference character. Here, unit 118 is realized as a chiller with refrigerant pumps (block 665) and an insulated CTSM storage and heat exchange unit 667. During off-peak conditions, the chiller 665 pumps refrigerant into storage unit 667, where it cools CTSM (e.g., freezing ice). During subsequent peak demand conditions, cooling water is routed through unit 667 to cool it prior to its entry to the condenser 114. Cooling towers 669 are preferably provided with suitable fans to aid in heat rejection into ambient air by forced convection. The CTSM storage and heat exchange system may also allow for "free cooling" using insulated dampers 671 during times when the outside air temperature is lower than that of the CTSM. The embodiment of FIG. 6 employs multi-pass heat exchangers 673. As discussed above, these may be useful in certain circumstances, such as the case where the CTSM temperature is allowed to rise; in order to accommodate this temperature rise while still cooling the cooling water to the desired temperature for inlet to the condenser, a second heat exchange pass 673 (or additional passes) could be used. Inasmuch as, in one or more embodiments, the cooling towers are used not merely for the condensers of the chillers, but also to reduce the pressure in the cold storage chamber, it is desirable that the area between the cold storage chamber and the cooling towers be insulated but with doors (e.g., dampers) that can be selectively actuated when it is desired to reduce the pressure. Any suitable natural or commercial refrigerant can be employed, subject of course to any applicable environmental and/or safety considerations; e.g., ammonia, R-134a, R-410A, R-407C, and the like.

In some instances, to freeze the ice inside unit 459, finned tubes immersed in water may be employed to freeze from the bottom and allow the ice to float to the top. The dampers 671 have been discussed above. Note that multiple passes 673 can be employed in any case, not merely in the embodiment of FIG. 6. In some instances, a valve is operated to dynamically take another pass as the CTSM temperature rises.

Note also make-up water pipe 699 to provide additional water to make up for that lost in evaporation (also used in open systems where the ice is mixed with the condenser cooling water and discharged to the environment). In addition, note optional vacuum chamber 697 (not to scale) which is placed under vacuum during off-peak times and used to reduce the pressure in chamber 667 under peak conditions to facilitate evaporation of the CTSM, as described elsewhere herein.

The skilled artisan will appreciate that the aforementioned Ellis reference stores energy in both hot and cold temperature reservoirs during off peak whereas one or more embodiments of the invention store energy only in a cold temperature reservoir and use the existing fuel-fired boiler or nuclear reactor for the high-temperature source. Furthermore, Ellis' reservoirs provide the sole heat source and sink for the system as opposed to supplementing and/or enhancing existing condenser cooling water in one or more embodiments of the invention.

If a system using techniques of Ellis was built next to an existing power plant and used to store energy in hot and cold reservoirs, the other aspects of the existing plant—turbine, pumps, condenser, etc. —could not be used; New equipment would have to be built, or else if the old equipment was operated using Ellis' reservoirs, the boiler and condenser of Ellis could not operate at the same time. One or more embodiments of the invention enhance performance of an existing system, which continues to operate with its current equipment but has increased capacity (or optionally, lower fuel consumption for the same capacity) due to the reduced low temperature sink.

The skilled artisan will also appreciate that the aforementioned Ellis reference includes a hot storage aspect and also a cold storage aspect. Focusing on the cold storage aspect of Ellis, it will be appreciated that in Ellis' design, the cold storage design per se would be useless. The Ellis system seeks to take a generation system, namely, turbine, pumps, and so on, which would otherwise be idle, and use the stored energy to run the system. Conversely, one or more embodiments of the invention address the situation of a generation system that is running at capacity, and add to the capacity of the system. Viewed in this way, the cold storage aspect of Ellis's system is an adjunct to the hot storage part; the power is extracted from the cold and hot temperature reservoirs using a dedicated system that would otherwise be idle. One or more embodiments of the invention create a cold-temperature sink to enhance the capacity of an existing power plant, by reducing the temperature of its low temperature heat sink. Furthermore, in one or more embodiments, unlike Ellis, the cold temperature storage medium is used to cool an ambient fluid (e.g., river water) rather than the working fluid per se. In one or more embodiments, this aspect allows for more efficient operation, inasmuch as the cold temperature storage medium is not burdened with having to deal with the latent heat of vaporization. In a typical steam plant, the vast majority of the heat rejected is associated with the condensing process (latent heat of vaporization) rather than with sensible heat (temperature difference). One or more embodiments cool the cooling water rather than the working fluid.

In one or more embodiments, design procedures for retrofit installations and design procedures for new construction installations are fairly similar; however, the actual construction techniques will tend to differ somewhat between retrofit and new construction.

It should be noted that in some instances, to obtain the full benefit of one or more embodiments, an additional turbine stage may be employed, especially in hot climates where the turbine may not be sized for operation at low steam pressures and temperatures.

It should also be noted that water ice is a non-limiting example of a suitable cold temperature storage medium. For example, a suitable phase change material could be employed, such as paraffin, fatty acids, or the like.

DEFINITIONS

Any mention of ton, tons, or tonnage, refers to the metric version of the unit. The following definitions are used herein:

S=Size of CTSM making machine in tons per day.

$m_{CTSM}$=Mass of CTSM in tons.

$t_c$=Time in hours to fully charge CTSM.

$m_{hour}$=Mass of CTSM consumed during one hour of discharging in tons.

$t_d$=Time in hours to fully discharge the CTSM, $m_{coolnew}$=Hourly mass flow rate of the cooling water during discharge.

$m_{coolold}$=Hourly mass flow rate of the cooling water during under hypothetical situation in which the same amount of heat is absorbed by the cooling water as in discharge, but the temperature difference in the cooling water is the same as during normal operation.

$c_{CTSM}$=Specific heat capacity of the CTSM.

$T_{cool2}$=Temperature of the cooling water after being cooled by the CTSM.

$T_{cool1}$=Condensing temperature during discharge.

$T_{cool0}$=Temperature of the cooling water upon entering the power plant from its original source (i.e.: lake, river, etc).

$E_{CTSM}$=Energy density of the CTSM in kJ/ton.

$hf_{CTSM}$=Enthalpy of fusion of the CTSM.

$\Delta T_{CTSM}$=Temperature change in CTSM during discharge.

$he_{CTSM}$=Enthalpy of evaporation of CTSM.

$X_{CTSM}$=Percentage of CTSM that evaporates during discharge.

The following equations are provided to assist the skilled artisan in design of one or more embodiments.

$$S = \frac{24 m_{CTSM}}{t_c} \tag{1}$$

$$m_{CTSM} = (m_{hour})(t_d) \tag{2}$$

$$m_{hour} = \frac{m_{coolnew} c_{CTSM} (T_{cool2} - T_{cool0})}{E_{CTSM}} \tag{3}$$

$$m_{coolnew} = \frac{(T_{cool1} - T_{cool0})}{(T_{cool1} - T_{cool2})} (m_{coolold}) \tag{4}$$

$$E_{CTSM} = hf_{CTSM} + c_{CTSM} \Delta T_{CTSM} + X_{CTSM} he_{CTSM} \tag{5}$$

Exemplary Steps for System Design

For illustrative purposes, a plant retrofit case will be considered first. In one or more embodiments, the main differences between retrofit and new construction will be in terms of constraints and optimization. In a new construction, the entire construction can be optimized, including the storage system, constrained only by the size of the available plot of land and the budgetary constraints. On the other hand, in the case of a retrofit, there are likely to be even more severe land constraints as a good portion of the available land is likely already taken up with the existing plant and thus the available space for the cold temperature storage system is likely to be significantly constrained. One or more embodiments do require fairly significant amounts of space, on the order of a warehouse-sized building.

Step 1: Data Collection—

In order to properly size the storage system, the size of the power plant, along with the following pieces of operational data are obtained in one or more embodiments (for a new plant, one would instead design the actual power plant with the storage system in mind and this step would be based on the parameters of the proposed system). In this step, there is an estimation as to how the system will perform (what type of benefit will it generate) when it is discharging; how quickly will the cold storage medium be consumed during discharge (will depend upon flow rate of condenser water, temperatures of the condenser water at inlet, and so on); and whatever siting and/or space constraints may be present. Information should also be gathered on historic energy prices in the area so as to estimate what kind of revenue the system can be expected to generate, it being understood that energy prices are volatile and not amendable to exact prediction. The system optimization and design will be influenced by the potential monetary benefit versus the up-front costs. The age and expected lifetime of the plant should also be taken into consideration. Nuclear plants have licenses which expire by a certain date. For coal fired plants a rough idea can be obtained as to how long the plant is expected to last. Thus, an approximate idea as to how long the plant will continue to operate should be developed and used in the economic modeling.

Pertinent data includes:

- Condenser water temperature (say a river is being used as condenser water, daily temperatures of that river water).
- Temperature, pressure, and flow rate of working fluid at the turbine inlet.
- Largest turbine stage size and minimum steam pressure and steam quality tolerance.
- Steam quality at turbine exit.
- Average Delta T between condensing temperature and condenser water temperature at condenser inlet.
- Allowable rise in condenser water temperature under normal operating conditions. In this regard, the EPA and a number of states have guidelines, typically from 8-15 degrees C. One or more embodiments cool the condenser water. By the equation $q=mc_p\Delta T$, where q is the heat transfer rate, m is the mass flow rate, $c_p$ is the specific heat, and $\Delta T$ is the temperature differential, it will be seen that the amount of heat the cooling water can absorb is limited by the allowable temperature rise. It is often necessary to draw in huge amounts of water to get the desired q with the allowable $\Delta T$. The average 500 MW water-cooled power plant in the US may consume more than 225,000 gpm (15.8 $m^3/s$). This implies a significant amount of pumping power. By cooling the intake river water (say from 30 C down to 5 C), and being allowed to send it back to the river at, say, 40 C, there is an available 35 C $\Delta T$ instead of only 10 C $\Delta T$. This reduces the required amount of cooling water which is helpful in reducing the burden on the system and saves power in the condenser water pumps.
- Steam temperature and pressure at turbine exit (this would come in the form of daily data for a year).
- Space/Site constraints need to be considered for siting the project.
- Load information for the area the plant serves, historic pricing data, and other pertinent financial data to estimate potential revenue for purposes of optimization. In some instances the utilities may help fund the project due to load-shifting. Further, in certain areas, non-profit organizations such as ISOs and RTOs which oversee the energy markets and act as market clearing houses in different states and regions require, and create a market for, reserve power. For example, the New York ISO requires 15 minutes spinning reserve and 30 minutes non-spinning reserve. These types of reserve power can be bid into the marketplace in addition to bidding in energy and a fluid system would be able to bid in as reserve power if desired.

Step 2: System Sizing:

In following sizing equations (1) through (5), it will be appreciated that the two variables that should be chosen by the design team are $t_c$ and $t_d$, the amount of time to charge the system and the amount of time it takes the system to discharge under maximum load. Equations (1)-(5) allow the skilled artisan to calculate the required capacity S (typically measured in tonnage) of the CTSM-making machinery. It is currently believed that ordinary water ice is the preferred form of CTSM, but the invention is not limited to water ice. Where water ice is employed as the CTSM, the value of S in equation (1) yields the required capacity of the ice-making chiller. In general, refrigeration and ice-making systems are sized by the "ton"; a one-ton ice making chiller will produce one ton of ice every 24 hours. A 24 ton system will produce one ton of ice per hour. 100 tons of ice in an hour requires a 2400 ton system; if twelve hours can be taken, only a 200 ton system is needed. Equation (2) multiplies the amount of CTSM to be consumed in an hour by the desired total time of operation, in hours. The choice of $t_c$ and $t_d$ determines how to size the system. The design team should examine the economics of the power plant in question and the project budgetary constraints in picking these parameters. It is presently believed that $t_d$ should be picked first as it is directly determined by the size of the system (amount of CTSM). This also impacts the required size of the structure to house the CTSM system. A larger $t_d$ allows covering more of the peak demand time. Given $t_d$, the total mass of ice or other CTSM needed to be generated can be determined, and then $t_c$ can be determined based on the amount of chilling equipment it is feasible to install. The shorter the charge time, the larger and more expensive the system will be. However, where cheap power is available for a relatively short period of time, it may pay to have a larger chiller so most or all of the CTSM can be chilled during the period when energy is cheapest.

Still considering system sizing, another potentially significant aspect includes plant history in winter time conditions and/or a thermodynamic model using readily available equations that can be used to predict the performance of the storage system under a variety of conditions (year-long weather and load data for example). It should be noted that:

- Both $t_d$ and $t_c$ will directly impact the economic performance of the storage system. The charging time is directly dependent upon the size and amount of CTSM generation equipment (i.e. ice making chillers) in the system and the total mass of the CTSM; so, the shorter the charge time, the more expensive the system will be. Shorter charge times allow for more time in the discharge state and greater flexibility in choosing when, and thus, at what price to charge the system.

The discharge time will be affected by the mass and energy density of the CTSM. The greater the discharge time, the larger the storage facility that will be needed.

The cost and benefit of total charging and discharging times should be weighed and optimized.

Step 3: System Design:

The storage system will typically require a warehouse-size building. The building will house the CTSM generating equipment, pipes, pumps, and other associated equipment, and a well insulated bulk storage chamber for the CTSM. The CTSM generating equipment can be sized using standard methods. For example, if water ice is being used for the CTSM, then ice-making chillers will be used for the generation. Ice making chillers are typically sized in "tons"; tons refer to the amount of ice, in tons, the unit can generate in a day. So a one (1) ton ice making chiller can produce one (1) ton of ice in a 24 hour period; conversely, a twenty-four (24) ton chiller can produce one (1) ton of ice in an hour and twenty-four (24) tons of ice per day. Once Eq. (2) is solved for, Eq. (1) can be used to determine the size of the CTSM generation system.

The bulk storage system should be designed to be well insulated. Cooling tower fans should be located on the top of the bulk storage facility. The cooling tower fans should be sized both as a heat sink for the CTSM generation system during charging, and for reducing the pressure in the storage facility during discharge to encourage evaporation. The cooling tower fans can also be turned in reverse for free cooling during times when the condenser water is warmer than the outside air temperature.

The bulk storage facility should be designed to house the full mass of the CTSM in its least dense state with additional space for pipes and reserve space. Pipes running through the CTSM storage chamber will act as a large tube and shell heat exchanger with the shell being the storage facility itself. Fins are optionally but preferably added to the pipes to aid in heat exchange. Multiple passes of pipe can also be employed depending on how much heat exchange area is required. Furthermore, certain passes of pipe can have valves on them such that they are only used in instances when the temperature difference between the condenser water and the CTSM is small. Designers should also note not to oversize the heat exchange surface to the point where the condenser water begins to freeze; this could damage piping and also lead to inefficient operation.

In one or more embodiments, there are two sets of heat exchange pipes. One set is between the generation room and the storage room and the other is the condenser water pipes (preferably finned) running in multiple passes through the bulk storage system. Because the bulk storage system is such a large structure, and pipes (preferably un-insulated and with good thermal properties, e.g., copper, titanium, iron or steel) are to be run through the entire structure, and the pipes preferably are finned for enhanced heat transfer, the structure with piping in essence forms a large shell and tube heat exchanger which, given the teachings herein, can be sized using known heat exchanger sizing techniques (for example, similar to those used in geothermal applications for liquid-to-solid exchange). Referring again to FIG. 4, the latter set of pipes 499 is thus used to absorb heat from the condenser cooling water into the CTSM during discharge (peak), while the former set of pipes 497, 495 is used during charge (off peak) to connect the bulk storage chamber to the refrigeration system. The refrigerant is liquid at sub-freezing temperatures (say, 20 F=−6.67 C) and evaporates at say 22-25 F (−5.56 to −3.89 C). This refrigerant takes heat away from the thawed CTSM and turns it back into ice or other solid-phase CTSM. As described elsewhere herein, in some instances, some (in some cases, a significant amount) of the CTSM will evaporate and thus a make-up water pipe 699 is required as shown in FIG. 6. Turning again to FIG. 4, and with continued reference to FIG. 6, the compressor of the mechanical refrigeration system is in the chiller with refrigerant pumps room 457, the condenser is in the cooling tower or thermally coupled thereto by a suitable loop, and the evaporator is formed by the pipes in the CTSM building 459.

In one or more embodiments, the cooling towers serve several purposes. During charging of the system, the cooling towers supply the heat sink for the condenser of the mechanical refrigeration system. Cooling towers work by reducing the pressure in a system to encourage evaporation of water or other coolant at a lower temperature. In some instances, the latent heat of vaporization is significantly more than the latent heat of fusion, perhaps on the order of eight times. During the discharge cycle, once the ice or other CTSM has melted, it is possible in some instances to allow the temperature of the CTSM to rise above the freezing point; say, to as much as 40-45 F (4.44−7.22 C). This aids in evaporation and is dependent on the temperature of the condenser water; if the same is very warm it may be possible to allow the temperature of the molten CTSM to rise more than in other instances. With regard to vacuum on the CTSM chamber, running the fans will cut into the net benefit of the system due to the fan power. Fans are used to reduce the up-front costs of the system by getting more energy out of the ice, but at the cost of fan power. The vacuum created by the fans aids in evaporation of the molten CTSM. In essence, this turns the entire storage chamber into a fan-powered cooling tower. At present, it is believed that in one or more embodiments, 10-20% of the ice should be allowed to evaporate, in order to achieve adequate energy density. Referring to the damper 671 in FIG. 6, a further purpose for the fans is to take advantage of "free" cooling during times of colder ambient temperatures—say, for example, an August or September scenario where it is quite warm during the day and the cooling water is quite warm, but where the ambient air temperature cools significantly at night, to the point where it is lower than the cooling water. Some air cooling of the condenser water could be used to augment the CTSM.

Still with regard to system design, in one or more embodiments, significant parameters to be determined by the engineering team include the size of the storage system, which depends on a number of factors such as space constraints. In this regard, a short, wide and deep structure is preferred to a taller structure to limit the number of turns in the piping (which lead to pressure drop and consume pump power). The cooling tower should have actuated dampers to close off the cooling tower fans to ensure thermal insulation when not in use. The pipe between the condenser water and the bulk storage should also be thermally isolated during non-discharge conditions; for example, by using a bypass valve and isolation sections of low thermal conductivity piping (high thermal conductivity is of course preferred within the chamber—for example, sections 191, 193 could be made, at least in part, of a material with relatively low thermal conductivity, while portion 499 could be made of a high thermal conductivity material as described elsewhere herein).

Exemplary 500 MW Plant Retrofit

With reference now to FIG. 9, consider the following 500 MW "base case" steam cycle power plant. High pressure steam is generated in boiler 902 at a rate of 540.75 kg/s; it reaches 400° C. and 80 bar before entering high pressure turbine 904. Low pressure steam exits the high pressure turbine 904 at 12 bar and 188.65° C. The high pressure turbine develops approximately 191.2 MW of power. 359.06 kg/s of low pressure steam are sent to reheat heat exchanger 906 and heated to 400° C. at constant pressure; the remainder of the steam is sent to feedwater heater 908. Steam enters the low pressure turbine 910 at 400° C. and 12 bar and exits at 45.81° C. and 0.1 bar with a steam quality of about 92%; the low pressure turbine develops approximately 308.8 MW of power. Steam exiting the low pressure turbine is sent to water cooled condenser 912, where cooling water brought in at 22° C., at 914, is used to condense the steam. The cooling water temperature is allowed to rise by 12° C. to 34° C. at point 916.

Table 1 below presents the relevant thermodynamic information for the base case, wherein the "states" correspond to the encircled numerals in FIG. 9:

| State | Temperature (° C.) | Pressure (bar) | Enthalpy (kJ/kg) | Mass flow (kg/s) | Steam Quality (%) |
|---|---|---|---|---|---|
| 1 | 400 | 80 | 3139.3 | 540.75 | 100 |
| 2 | 188.65 | 12 | 2785.7 | 540.75 | 100 |
| 3 | 400 | 12 | 3261.2 | 359.06 | 100 |
| 4 | 45.81 | .1 | 2401.2 | 359.06 | 92 |
| 5 | 42.5 | — | 178.0 | 540.75 | 0 |
| 6 | 42.5 | 80 | 185.0 | 540.75 | 0 |
| 7 | — | — | 931.8 | 181.69 | — |
| 8 | 189.46 | 80 | 808.35 | 540.75 | — |
| 9 | 22 | — | | | — |
| 10 | — | | | | — |
| 11 | 34 | | | | — |

One pertinent step, which may be conducted initially in some instances, is to calculate the benefit of decreasing the condensing temperature of the system; for this demonstration, calculations will be shown for one lower condensing temperature and results will be presented for ten different condensing temperatures. As mentioned above, the base case system's low pressure turbine generates 308.8 MW of power. This can be calculated using Eq. (6):

$$E_{lp0}=m_2(h_2-h_4) \tag{6}$$

Inserting the values from the table:

$$E_{lp0}=308{,}740\text{kW}=359.06(3261.2-2401.2)$$

The above equation disregards turbine efficiency; since the storage system should not impact it, turbine efficiency will not be taken into account during this analysis. Eq. (6) also does not take into consideration the power required to pump the working fluid from State 5 to State 6 with pump 930. Eq. (7) shows the amount of work the pump must perform on the working fluid:

$$E_{pump}=\frac{m_5(h_6-h_5)}{\eta_{pump}} \tag{7}$$

Inserting values from the table and assuming a pump efficiency of 90%:

$$E_{pump}=\frac{540.75(185-178)}{.9}=4{,}205.9\text{ kW}$$

Thus, the pump requires approximately 4.21 MW of power to operate. Finally, the power plant efficiency can be defined as the net work produced by the cycle divided by the amount of heat added to the working fluid:

$$\eta=\frac{E_{out}}{E_{in}} \tag{8}$$

Inserting values from above:

$$\eta=\frac{191.2+308.8+4.21}{540.75(3.1393-0.80835)}=0.3933=39.33\%$$

By lowering $T_4$, $h_4$ is lowered and, as per Eq. (6), more energy can be extracted out of the cycle. For example, if T is lowered from 45.81° C. to 25.5° C., and the steam quality is kept constant at 92%, then the pressure falls to 0.0437 bar and the enthalpy falls to 2352.2 kJ/kg.

Solving Eq. (6) with these new values:

$$E_{lp0}=359.06(3261.2-2352.2)=326{,}385.5\text{kW}$$

The difference between $E_{lp1}$ and $E_{lp0}$ represents the gross "power boost" created by discharging the energy storage system. The net "power boost" is determined by considering the pump power required while the energy storage system is discharging; this can be found by solving Eq. (7) with new values for $h_5$ and $h_6$ ($m_5$ is the same as when not discharging). In Table 1, it is shown that the temperature of the condensate $T_5$ is actually 3.3° C. less than $T_4$; similarly, $T_5$ during discharge will be considered as 3.3° C. lower than $T_4$ during discharge, or 22.2° C. The enthalpy of the condensed working fluid is taken as the saturated liquid enthalpy at $T_5$:

$$h_5=93.126\text{kJ/kg}$$

The enthalpy at State 6 is found by isothermally increasing the pressure to 80 bar, thus:

$$h_6=100.573\text{kJ/kg}$$

Note that all of these enthalpy values can be found in standard steam tables. Solving Eq. (7) for the pump work requirements then leads to:

$$E_{pump1}=\frac{540.75(100.573-93.126)}{.9}=4{,}474.4\text{ kW}$$

Therefore the net "power boost" generated during discharge is 17.377 MW.

State 7 will change during discharge, but State 8 will remain the same. Therefore, calculated Eq. (8) with the new values is done as follows:

$$\eta_1=\frac{191.2+326.4-4.47}{540.75(3.1393-0.80835)}=0.407=40.7\%$$

Thus the storage system provides a 3.5% increase in net power generated by the entire cycle, a 5.6% increase in power generated by the low pressure turbine, and a 1.38% increase in cycle efficiency during discharge under these particular operating conditions.

The next step is to determine how much CTSM will be required for this set of discharge parameters; in other words, the "charging requirements" need to be determined. For this example, water ice will be used as the Cold Temperature Storage Medium. It is at this point that there is a difference in consideration between a retrofit and a new plant. In a retrofit, certain options like increasing the heat exchange surface area of the condenser (or the amount of condenser pipes) may not exist; in a new plant, the condenser could be sized optimally with the storage system taken into account.

First, consider a retrofit in which the condenser size cannot be changed. In this situation, the base case operation is considered as limiting for certain aspects of operation during discharge. More specifically, the ratio between the amount of heat transfer taking place in the condenser and the log mean temperature difference (LMTD) must be roughly the same or lower in the discharge case as in the base scenario. This is derived from the fact that heat transfer in a heat exchanger can be described using the following equation:

$$Q=(U)(A)(\text{LMTD}) \tag{9}$$

LMTD for a countercurrent heat exchanger is:

$$LMTD = \frac{(TH1 - TC2) - (TH2 - TC1)}{\ln\frac{(TH1 - TC2)}{(TH2 - TC1)}} \tag{10}$$

TH1 and TH2 refer to the inlet and exit temperatures on the hot side of the heat exchanger and TC1 and TC2 refer to the inlet and exit temperatures of the cold side of the heat exchanger respectively. In this example, the hot side of the heat exchanger is the working fluid, and the cold side is the condenser water. The hot side inlet and outlet are $T_4$ and $T_5$ and the cold side inlet and outlet are $T_9$ and $T_{11}$ respectively.

In Eq. (9), U and A refer to the heat exchanger effectiveness and the heat exchange area respectively; since these values will not change between discharge and ordinary operation, they can be considered as constants. Therefore, the ratio of Q to LMTD during discharge must be lower than or equal to the same ratio during ordinary operation. Before discussing how to calculate Q it is important to note qualitatively what Q is. There are two streams of working fluid being cooled in the condenser; the first enters from State 4, the second enters from State 7. For the purposes of analyzing the exemplary energy storage system, the former stream is the only one that needs to be considered. While operating the energy storage system, will, in fact impact State 7, the working fluid from that stream can still be cooled by ordinary condenser water (that is, condenser water that has not been cooled by the CTSM) since there is no benefit to cooling this fluid to a lower temperature. The amount of heat absorbed by the cooling water is equal to the amount of heat expelled by the working fluid, therefore during ordinary operation:

$$Q_0=m_4(h_4-h_5)=359.06(2401.2-178)=798{,}262\text{kW}$$

In this example, assume an environmental regulation that allows for no more than a 12° C. rise in water temperature, such that the difference between $T_{11}$ and $T_9$ during normal operation is 12° C. Therefore the LMTD using a countercurrent heat exchanger during normal operation is:

$$LMTD_0 = \frac{(45.81 - 34) - (42.5 - 22)}{\ln\frac{(45.81 - 34)}{(42.5 - 22)}} = 15.7576$$

During discharge:

$$Q_1=m_4(h_4-h_5)=359.06(2352.2-93.126)=811{,}143\text{kW}$$

Solving for the log mean temperature difference during discharge:

$$\text{LMTD}_1=16.012$$

If during discharge $T_4$ and $T_5$ are 25.5° C. and 22.2° C. respectively, then a viable option for $T_{10}$ and $T_{11}$ would be 3° C. and 12° C. respectively; that would lead to an LMTD of 16.183, which is slightly above the minimum requirement.

Next, determine the necessary mass flow rate of cooling water at these conditions:

$$m_9 = \frac{Q_1}{(c_p)(T_{11} - T_{10})} = \frac{811{,}143}{4.128(12 - 3)} = 21{,}833\ \frac{\text{kg}}{\text{s}}$$

The demand on the storage system, $Q_s$, comes from cooling the cooling water from $T_9$ to $T_{10}$; thus:

$$Q_s(m_9)(c_p)(T_9-T_{10}(21{,}833)(4.128)(12-3)=1{,}712{,}405\text{kW}$$

Finally, to determine the amount of ice needed to discharge the system, the energy density of the ice must be determined using Eq. (5). Thus, the energy density of the CTSM if 60% is allowed to evaporate (assisted by fans or natural draft) is as follows:

$$\begin{aligned} E_{CTSM} &= h_f + (c_p)(\Delta T_{CTSM}) + (X_{CTSM})(h_v) \\ &= 333.55 + (4.128)(2) + (0.6)(2506.4) \\ &= 1{,}842.2\ \frac{\text{kJ}}{\text{kg}} \end{aligned}$$

Accordingly, the amount of CTSM required to operate at this level of discharge is 951.3 kg/s. These calculations can be performed for a variety of discharge conditions by altering the value of $T_4$ during discharge and solving the same calculations. The relevant information for ten values of $T_4$ is presented below in Table 2 (Note that these results are exemplary, non-limiting, and have not necessarily been optimized; they are a demonstration of what different operational conditions may look like):

TABLE 2

| T4 | Net Power (MW) | Net Power Boost (MW) | Efficiency | CTSM Burn Rate (kg/s) |
|---|---|---|---|---|
| 44 | 497.4732 | 4.7767 | 39.71% | 59.8737 |
| 42 | 501.9664 | 6.1723 | 39.88% | 140.8985 |
| 40 | 503.3643 | 7.5702 | 39.99% | 213.5024 |
| 38 | 504.7643 | 8.9702 | 40.19% | 281.1742 |
| 36 | 506.1664 | 10.3723 | 40.21% | 322.1390 |
| 34 | 507.5705 | 11.7764 | 40.32% | 371.1866 |
| 32 | 508.9762 | 13.1821 | 40.44% | 415.6669 |
| 30 | 510.3837 | 14.5896 | 40.55% | 492.8726 |
| 28 | 511.7926 | 15.9985 | 40.66% | 613.6573 |
| 26 | 513.2029 | 17.4088 | 40.72% | 827.9128 |

Again, note that these results are illustrative and do not necessarily represent an optimum; further, they contain rounding error and the steam quality has been rounded to the nearest full percent (92%). In a real system, fluctuations on the order of these rounding errors are to be expected in any case. Also note that these data do not take into account power required to run a fan to assist in evaporating the CTSM; such fans may or may not be necessary depending upon the configuration (natural draft cooling versus forced draft) and their power requirements will depend heavily upon ambient air temperature and humidity.

Given the teachings herein, the skilled artisan will be able to apply principles of engineering economy to size a storage system appropriate for a given application. For demonstration purposes, consider a case in which it is optimal to design a system such that it can be discharged for 3 hours producing a power boost of 4.78 MW, and 1 hour producing 14.59 MW, and be charged in 12 hours. Such a system would require a total of 2,027.46 tons of ice per charge. In order to charge that system in 12 hours, 4,054.91 tons of chiller equipment will need to be installed. 2,027.46 tons of ice requires approximately 2,212 $m^3$ of insulated space, plus the space to house the piping and other equipment. Overall, the system would store 28.93 MWh per charge. If the installed cost for the system were $1000/ton (consistent with the lower bound of chiller plants, which is believed accurate since the exemplary installation does not require the same amount of pumps, electrical work, or piping as regular chiller plants require), then the total cost would be $4,054,910.00 or $140.16/kWh which is competitive with existing energy storage technologies.

In FIG. 9, note also the condensate trap 951 and second feedwater heater 953.

Please note that all currency units herein are expressed in United States dollars.

Exemplary 500 MW Plant New Design or Flexible Retrofit

Now consider a case in which the size of the condenser is not fixed. This could happen in a new power plant situation, or in a retrofit in which tubes could be added to the existing condenser. In this example, everything else is held the same as the retrofit example described above, but the condenser is allowed to have roughly 20% more surface area. Recall that environmental regulation and the ambient conditions kept $T_9$ and $T_{11}$ at 22° C. and 34° C. respectively; the condenser in the first situation thus allowed $T_4$ to be equal to 45.81° C. in the base case with the larger condenser, $T_9$ and $T_{11}$ would still be 22° C. and 34° C., but $T_4$ would be 43.3° C. The new base case net power generation of the plant would then be 501.0590 MW with a thermal efficiency of 39.75%.

TABLE 3

| T4 | Net Power (MW) | Net Power Boost (MW) | Efficiency | CTSM Burn Rate (kg/s) |
|---|---|---|---|---|
| 42 | 501.9664 | 0.9074 | 39.82% | 12.6193 |
| 40 | 503.3643 | 2.3053 | 39.99% | 100.8985 |
| 38 | 504.7643 | 3.7053 | 40.19% | 176.7829 |
| 36 | 506.1664 | 5.1074 | 40.21% | 268.4744 |
| 34 | 507.5705 | 6.5115 | 40.32% | 363.9084 |
| 32 | 508.9762 | 7.9172 | 40.44% | 430.0479 |
| 30 | 510.3837 | 9.3247 | 40.55% | 519.5819 |
| 28 | 511.7926 | 10.7336 | 40.66% | 555.2113 |
| 26 | 513.2029 | 12.1439 | 40.72% | 597.5094 |
| 24 | 514.6144 | 13.5554 | 40.83% | 774.7567 |

Note that the results in Table 3 have not necessarily been optimized; they are a demonstration of what different operational conditions may look like in non-limiting exemplary embodiments.

Given the discussion thus far, it will be appreciated that, in general terms, an exemplary method, according to an aspect of the invention, includes the step of, during off-peak operation of a power plant (e.g., FIG. 1 or FIG. 9) operating on a thermodynamic cycle wherein heat is rejected to an ambient fluid, removing heat from a cold temperature storage medium. An additional step includes storing the cold temperature storage medium (e.g., in unit 355, 459, 886, 563, 667) until the power plant is experiencing a peak period. An even further step includes, during the peak period, using the stored cold temperature storage medium to absorb heat from the ambient fluid (e.g., cooling water) prior to heat rejection from the thermodynamic cycle to the ambient fluid, to improve performance (e.g., maximum potential power output or thermodynamic efficiency—increased power output or lower amount of fuel used; former is preferred over latter) of the thermodynamic cycle.

In one or more embodiments, the ambient fluid (e.g., river, lake, or sea water) is separate from the CTSM and the thermodynamic cycle working fluid.

Note that a thermodynamic cycle includes of a series of thermodynamic processes transferring heat and work, while varying pressure, temperature, and other state variables, eventually returning a system to its initial state. In the process of going through this cycle, the system may perform work on its surroundings, thereby acting as a heat engine. In thermodynamics, a heat engine is a system that performs the conversion of heat or thermal energy to mechanical work. It does this by bringing a working substance from a high temperature state to a lower temperature state. A heat "source" generates thermal energy that brings the working substance in the high temperature state. The working substance generates work in the "working body" of the engine while transferring heat to the colder "sink" until it reaches a low temperature state. During this process some of the thermal energy is converted into work by exploiting the properties of the working substance. The working substance can be any system with a non-zero heat capacity, but it usually is a gas or liquid.

In some instances, the ambient fluid is ambient water which undergoes a temperature drop during the step of using the stored cold temperature storage medium to absorb heat from the ambient fluid during the peak period, such that a heat rejection temperature of the thermodynamic cycle is reduced below an ambient temperature of the ambient water.

In some cases, the thermodynamic cycle is a Rankine cycle and the heat is rejected to the ambient fluid by passing the ambient fluid and a working fluid of the Rankine cycle through a condenser 114 wherein the ambient fluid condenses the working fluid.

In one or more embodiments, the cold temperature storage medium does not undergo a phase change and the removal of the heat from the cold temperature storage medium causes a drop in temperature of the cold temperature storage medium.

In a preferred approach, however, the cold temperature storage medium undergoes a phase change and at least a portion of the removal of the heat from the cold temperature storage medium does not cause a drop in temperature of the cold temperature storage medium.

In one or more embodiments, the cold temperature storage medium is water frozen into ice during the step of removing the heat from the cold temperature storage medium.

In at least some cases, the cold temperature storage medium is stored in a storage unit 118, 355, 459, 886, 563, 667, and an additional step includes using a flow control system (e.g., valve 120) to bypass the ambient fluid with respect to the storage unit during the off-peak operation and to cause the stored cold temperature storage medium to absorb the heat from the ambient fluid during the peak period.

In some instances, referring to FIG. 2, an additional step includes providing a heat exchanger 251 between a source of the ambient fluid (e.g., the cooling water supply 116) and the condenser 114. The cold temperature storage medium is stored in a storage unit 118, and further steps include operating a refrigerant loop during the off-peak operation to absorb the heat from the ambient fluid during the peak period, in the heat exchanger 251, and rejecting the heat to the cold temperature storage medium stored in the storage unit 118. In this regard, note that, although FIG. 2 shows a bypass valve 120, in some cases, this could be dispensed with and the refrigerant loop shut off during charging conditions.

In another aspect, some embodiments include the step of providing a heat exchanger between a source of the ambient fluid (e.g., 116) and the condenser 114. The heat exchanger is formed by an insulated cold temperature storage medium storage chamber 459, 563, 667 with pipes 499, 673 for the ambient fluid passing therethrough. The cold temperature storage medium is generated by a chiller unit 457, 561, 665 with refrigerant pumps. The chiller unit can be external (457, 665) or internal (561) to the storage chamber.

As noted, during the off-peak operation of the power plant operating on the thermodynamic cycle wherein the heat is rejected to the ambient fluid, the removing of the heat from the cold temperature storage medium can carried out using excess power available from the power plant (e.g., electrical power output from the generator(s) or blow-off steam used to power a steam-powered chiller) or power from a source external to the power plant (e.g., electrical power or steam purchased from the grid at off-peak rates).

Figure 8:
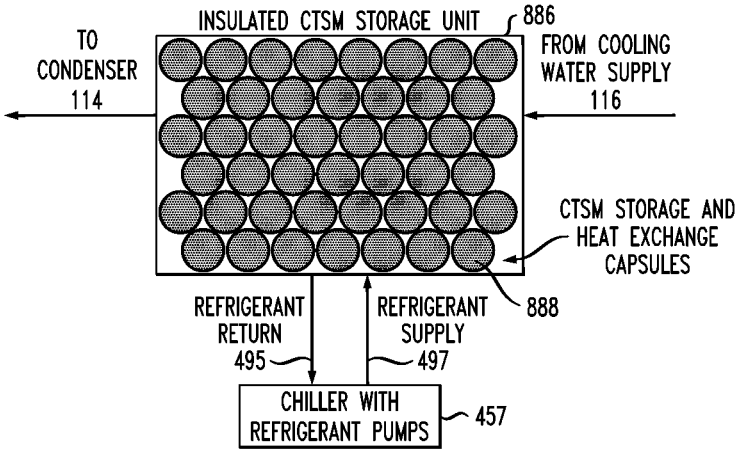
FIG. 8 shows flow diagram for CTSM storage and generation units with refrigerant loop and CTSM storage capsules, according to an aspect of the invention.

In some cases, as shown in FIG. 8, the cold temperature storage medium is encapsulated in a plurality of capsules 888 provided within an insulated storage unit 886; and the heat is rejected from the thermodynamic cycle to the ambient fluid in a condenser 114. In such cases, further steps can include providing a heat exchanger between a source of the ambient fluid 116 and the condenser 114. The heat exchanger is formed by the insulated storage unit 886 and the ambient fluid passing therethrough (cooling water or other ambient fluid comes in from the supply 116, flows over the capsules, is cooled thereby, and exits to the condenser at 114). A further step includes operating a refrigerant loop 457, 495, 497 during the off-peak operation to freeze the cold temperature storage medium encapsulated in the plurality of capsules.

In some instances, an additional step includes storing a vacuum (e.g., in chamber 697) during the off-peak operation and using the stored vacuum to aid evaporation of the cold temperature storage medium during the peak period.

In another aspect, an exemplary method includes the step of, during off-peak operation of a power plant (e.g., FIG. 1, FIG. 9) operating on a thermodynamic cycle wherein heat is rejected to an ambient fluid, removing heat from a cold temperature storage medium. A further step includes storing the cold temperature storage medium until the power plant is experiencing a peak period. A still further step includes, during the peak period, mixing the stored cold temperature storage medium with the ambient fluid to lower temperature of the ambient fluid prior to heat rejection from the thermodynamic cycle to the ambient fluid, to improve performance of the thermodynamic cycle. In a preferred but non-limiting approach, the ambient fluid is ambient water; and the cold temperature storage medium is water frozen into ice during the step of removing the heat from the cold temperature storage medium. In some cases, ice cubes can be formed that are small enough to be directly mixed with the cooling water prior to entry to the condenser, and the mass flow of cooling water can be adjusted as appropriate. FIG. 10 shows a non-limiting example of a "mixing" embodiment. Items similar to those in FIG. 2 have received the same reference character. In the embodiment of FIG. 10, cooling water from supply 116 enters combined mixing chamber and CTSM storage unit 1051, where the cooling water physically mixes with the CTSM. The CTSM is frozen during off-peak conditions using unit 1018. Detail view 1099 shows one non-limiting exemplary arrangement of the unit 1051, wherein frozen CTSM is stored in a hopper 1097 disposed over an open channel 1095 through which frozen CTSM is dispensed into the cooling water. In an alternative approach, the cooling water could simply run over the frozen CTSM.

In still another aspect, an exemplary system includes a power plant (e.g., FIG. 1 or FIG. 9) operating on a thermodynamic cycle wherein heat is rejected to an ambient fluid, as well as a cold temperature storage medium storage unit 118, 355, 459, 886, 563, 667; and a refrigeration arrangement 353, 457, 561, 665 configured to remove heat from cold temperature storage medium stored in the cold temperature storage medium storage unit during off-peak operation of the power plant. Also included is a heat exchanger (e.g., 251 or the shell and tube exchanger formed by the storage unit with cooling water pipes therethrough) configured to cause, during peak operation of the power plant, the stored cold temperature storage medium to absorb heat from the ambient fluid prior to heat rejection from the thermodynamic cycle to the ambient fluid, to improve performance of the thermodynamic cycle.

In some cases, the ambient fluid is ambient water which undergoes a temperature drop when the stored cold temperature storage medium absorbs the heat from the ambient fluid during the peak period, such that a heat rejection temperature of the thermodynamic cycle is reduced below an ambient temperature of the ambient water.

In many cases, the thermodynamic cycle is a Rankine cycle with a condenser, and the heat is rejected to the ambient fluid by passing the ambient fluid and a working fluid of the Rankine cycle through the condenser 114 wherein the ambient fluid condenses the working fluid.

In some cases, the cold temperature storage medium does not undergo a phase change and the removal of the heat from the cold temperature storage medium causes a drop in temperature thereof.

However, in a preferred approach, the cold temperature storage medium undergoes a phase change and at least a portion of the removal of the heat from the cold temperature storage medium does not cause a drop in temperature thereof.

Preferably, the cold temperature storage medium includes water frozen into ice during the removal of the heat from the cold temperature storage medium.

One or more embodiments further include a flow control system (e.g., valve 120) configured to bypass the ambient fluid with respect to the storage unit during the off-peak operation and to cause the stored cold temperature storage medium to absorb the heat from the ambient fluid during the peak period.

As noted, in many cases, the heat exchanger is formed by the cold temperature storage medium storage unit 355, 459, 563, 667 and pipes 499, 673 for the ambient fluid passing therethrough, and the refrigeration arrangement includes a chiller unit 457, 561, 665 with refrigerant pumps. The chiller unit can be external to the cold temperature storage medium storage unit, as per 457, 665, or the chiller unit can be internal to the cold temperature storage medium storage unit, as at 561.

As shown in FIG. 8, in some cases, the cold temperature storage medium is encapsulated in a plurality of capsules 888 provided within the cold temperature storage medium storage unit 886; the heat is rejected from the thermodynamic cycle to the ambient fluid in a condenser 114; and the heat exchanger is formed by the cold temperature storage medium storage unit 886 and the ambient fluid passing therethrough and over the capsules, as explained above.

In some cases, the system further includes a vacuum chamber 697 configured to store a vacuum during the off-peak operation and to use the stored vacuum to aid evaporation of the cold temperature storage medium during the peak period.

In a further aspect, an exemplary system includes a power plant (e.g., FIG. 1 or FIG. 9) operating on a thermodynamic cycle wherein heat is rejected to an ambient fluid; a cold temperature storage medium storage unit; and a refrigeration arrangement configured to remove heat from cold temperature storage medium stored in the cold temperature storage medium storage unit during off-peak operation of the power plant. Also included is a mixing unit (see discussion of FIG. 10) configured to cause, during peak operation of the power plant, the stored cold temperature storage medium to mix with the ambient fluid prior to heat rejection from the thermodynamic cycle to the ambient fluid, to improve performance of the thermodynamic cycle. In a preferred but non-limiting approach, the ambient fluid is ambient water; and the cold temperature storage medium is water frozen into ice during the step of removing the heat from the cold temperature storage medium.

In an even further aspect, an exemplary method is provided for retrofitting a power plant (e.g., FIG. 1 or FIG. 9) operating on a thermodynamic cycle wherein heat is rejected to an ambient fluid with an indirect cold temperature thermal energy storage system for peak conditions. The method includes providing a cold temperature storage medium storage unit 118, 355, 459, 886, 563, 667; and providing a refrigeration arrangement 353, 457, 561, 665 configured to remove heat from cold temperature storage medium stored in the cold temperature storage medium storage unit during off-peak operation of the power plant. The method further includes providing a heat exchanger (e.g., 251 or the shell-and-tube exchanger formed by the storage chamber and pipes, or the chamber and capsules) configured to cause, during peak operation of the power plant, the stored cold temperature storage medium to absorb heat from the ambient fluid prior to heat rejection from the thermodynamic cycle to the ambient fluid, to improve performance of the thermodynamic cycle. Additional optional steps include sizing the system components.

In yet a further aspect, another exemplary method is provided for retrofitting a power plant (e.g., FIG. 1 or FIG. 9) operating on a thermodynamic cycle wherein heat is rejected to an ambient fluid with an indirect cold temperature thermal energy storage system for peak conditions. The method includes providing a cold temperature storage medium storage unit; providing a refrigeration arrangement configured to remove heat from cold temperature storage medium stored in the cold temperature storage medium storage unit during off-peak operation of the power plant; and providing a mixing unit configured to cause, during peak operation of the power plant, the stored cold temperature storage medium to mix with the ambient fluid prior to heat rejection from the thermodynamic cycle to the ambient fluid, to improve performance of the thermodynamic cycle. Refer to the discussion of FIG. 10.

System and Article of Manufacture Details

Non-limiting examples of aspects of the invention that may be implemented in accordance with this section include computer control of a power plants or portions thereof, as well as computer-aided design of new and/or retrofit installations. These aspects of the invention can employ hardware or hardware and software. Software includes but is not limited to firmware, resident software, microcode, etc. One or more embodiments of the invention or elements thereof can be implemented in the form of an article of manufacture including a machine readable medium that contains one or more programs which when executed implement or facilitate implementation of certain step(s); that is to say, a computer program product including a tangible computer readable recordable storage medium (or multiple such media) with computer usable program code configured to implement or facilitate implementation of any one, some, or all of the method steps indicated, when run on one or more processors. Furthermore, one or more embodiments of the invention or elements thereof can be implemented in the form of an apparatus including a memory and at least one processor that is coupled to the memory and operative to perform, or facilitate performance of, exemplary method steps.

Yet further, in another aspect, one or more embodiments of the invention or elements thereof can be implemented in the form of means for carrying out or otherwise facilitating one or more of the method steps described herein; the means can include (i) hardware module(s), (ii) software module(s) stored in a tangible computer readable storage medium (or multiple such media) and implemented on a hardware processor, or (iii) a combination of (i) and (ii); any of (i)-(iii) implement the specific techniques set forth herein. Appropriate interconnections via bus, network, and the like can also be included.

Figure 7:
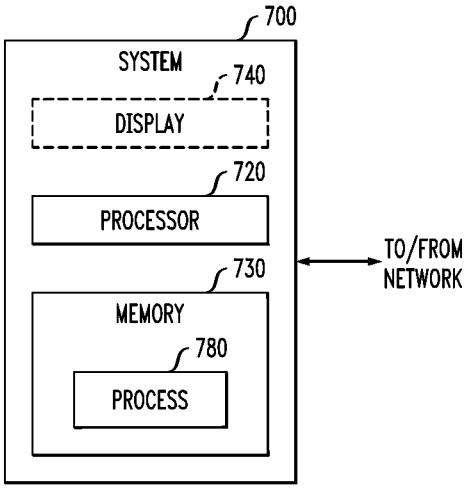
FIG. 7 depicts a computer system that may be useful in implementing one or more aspects and/or elements of the invention.

FIG. 7 is a block diagram of a system 700 that can implement part or all of one or more aspects or processes of the present invention; for example, by providing at least a portion of a controls system and/or providing an environment to run computer aided design software for solving the design equations provided herein. In one or more embodiments, inventive steps are carried out by one or more of the processors in conjunction with one or more interconnecting network(s) or other interconnections to mechanical or thermal devices such as valves, valve actuators, thermocouples or other temperature sensors, pressure transducers, flow rate sensors, and the like.

As shown in FIG. 7, memory 730 configures the processor 720 to implement one or more aspects of the methods, steps, and functions disclosed herein (collectively, shown as process 780 in FIG. 7). The memory 730 could be distributed or local and the processor 720 could be distributed or singular. The memory 730 could be implemented as an electrical, magnetic or optical memory, or any combination of these or other types of storage devices. It should be noted that if distributed processors are employed, each distributed processor that makes up processor 720 generally contains its own addressable memory space. It should also be noted that some or all of computer system 700 can be incorporated into an application-specific or general-use integrated circuit. For example, one or more method steps could be implemented in hardware in an ASIC rather than using firmware. Display 740 is representative of a variety of possible input/output devices (e.g., mice, keyboards, printers, etc.).

The network interface can also be used to gather data from temperature sensors, pressure transducers, flow meters, and the like; a separate interface such as one or more analog-to-digital converters could also be employed for this purpose. Furthermore, the network interface and/or a separate interface can also be employed to send control signals for control of valves, dampers, and the like.

As is known in the art, part or all of one or more aspects of the methods and apparatus discussed herein may be distributed as an article of manufacture that itself includes a computer readable medium having computer readable code means embodied thereon. The computer readable program code means is operable, in conjunction with a computer system, to carry out all or some of the steps to perform the methods or create the apparatuses discussed herein. The computer readable medium may be a recordable medium (e.g., floppy disks, hard drives, compact disks, EEPROMs, or memory cards) or may be a transmission medium (e.g., a network including fiber-optics, the world-wide web, cables, or a wireless channel using time-division multiple access, code-division multiple access, or other radio-frequency channel). Any medium known or developed that can store information suitable for use with a computer system may be used. The computer-readable code means is any mechanism for allowing a computer to read instructions and data, such as magnetic variations on a magnetic medium or height variations on the surface of a compact disk. As used herein, a tangible computer-readable recordable storage medium is intended to encompass a recordable medium which stores instructions and/or data in a non-transitory manner, examples of which are set forth above, but is not intended to encompass a transmission medium or disembodied signal.

The computer systems and servers described herein each contain a memory that will configure associated processors to implement or otherwise facilitate the methods, steps, and functions disclosed herein. Such methods, steps, and functions can be carried out, e.g., by mechanical, thermal, or fluid elements in the other figures, or by any combination thereof. The memories could be distributed or local and the processors could be distributed or singular. The memories could be implemented as an electrical, magnetic or optical memory, or any combination of these or other types of storage devices. Moreover, the term "memory" should be construed broadly enough to encompass any information able to be read from or written to an address in the addressable space accessed by an associated processor. With this definition, information on a network is still within a memory because the associated processor can retrieve the information from the network.

Thus, elements of one or more embodiments of the present invention can make use of computer technology with appropriate instructions to implement or otherwise facilitate method steps described herein.

As used herein, including the claims, a "server" includes a physical data processing system (for example, system 700 as shown in FIG. 7) running a server program. It will be understood that such a physical server may or may not include a display, keyboard, or other input/output components.

Furthermore, it should be noted that any of the methods described herein can include an additional step of providing a system comprising distinct software modules embodied on one or more tangible computer readable storage media. All the modules (or any subset thereof) can be on the same medium, or each can be on a different medium, for example. The modules can include, for example, one or more modules to implement at least a portion of a controls system (for example, to control and/or receive data from mechanical or thermal devices such as valves, valve actuators, thermocouples or other temperature sensors, pressure transducers, flow rate sensors, and the like) and/or to implement computer aided design software for solving the design equations provided herein. The method steps can then be carried out using the distinct software modules of the system, as described above, executing on the one or more hardware processors. Further, a computer program product can include a tangible computer-readable recordable storage medium with code adapted to be executed to carry out one or more method steps described herein, including the provision of the system with the distinct software modules. In one or more embodiments, the code is stored in a non-transitory manner.

Non-limiting examples of languages that may be used include markup languages (e.g., hypertext markup language (HTML), extensible markup language (XML), standard generalized markup language (SGML), and the like), C/C++, assembly language, Pascal, Java, FORTRAN, MATLAB, and the like.

Accordingly, it will be appreciated that one or more embodiments of the invention can include a computer program including computer program code means adapted to perform or otherwise facilitate one or all of the steps of any methods or claims set forth herein when such program is implemented on a processor, and that such program may be embodied on a tangible computer readable recordable storage medium. Further, one or more embodiments of the present invention can include a processor including code adapted to cause the processor to carry out or otherwise facilitate one or more steps of methods or claims set forth herein, together with one or more apparatus elements or features as depicted and described herein.

Although illustrative embodiments of the present invention have been described herein with reference to the accompanying drawings, it is to be understood that the invention is not limited to those precise embodiments, and that various other changes and modifications may be made by one skilled in the art without departing from the scope or spirit of the invention.

What is claimed is:

1. A method comprising:

during off-peak operation of a power plant operating on a Rankine power cycle:

running said power plant at a first capacity with heat added to a working fluid of said Rankine power cycle at a high temperature, $T_H$, and rejected from said working fluid, in a condenser of said Rankine power cycle, to cooling fluid at an ambient temperature, $T_L$; and removing heat from a cold temperature storage medium so as to at least partially freeze said cold temperature storage medium;

storing said cold temperature storage medium from which said heat has been removed and which has been at least partially frozen until said power plant is experiencing a peak period; and during said peak period:

using said stored cold temperature storage medium to absorb heat from said cooling fluid at said ambient temperature $T_L$, to provide reduced temperature cooling fluid having a temperature below $T_L$;

adding heat to said working fluid of said Rankine power cycle at said high temperature, $T_H$; and rejecting heat from said working fluid of said Rankine power cycle to said reduced temperature cooling fluid in said condenser wherein said reduced temperature cooling fluid condenses said working fluid of said Rankine power cycle, thus improving thermodynamic efficiency of said Rankine power cycle, as compared to said off-peak operation, by rejecting said heat from said working fluid of said Rankine power cycle to said reduced temperature cooling fluid rather than said cooling fluid at said ambient temperature, $T_L$, said improved thermodynamic efficiency resulting in a second capacity greater than said first capacity.

2. The method of claim 1, wherein said cooling fluid comprises water from at least one of a river, a lake, and a sea.

3. The method of claim 1, wherein said cold temperature storage medium comprises water frozen into ice during said step of removing said heat from said cold temperature storage medium.

4. The method of claim 3, wherein said cold temperature storage medium is stored in a storage unit, further comprising using a flow control system to bypass said cooling fluid with respect to said storage unit during said off-peak operation and to cause said stored cold temperature storage medium to absorb said heat from said cooling fluid during said peak period.

5. The method of claim 3, further comprising providing a heat exchanger between a source of said cooling fluid and said condenser, wherein said cold temperature storage medium is stored in a storage unit, further comprising operating a refrigerant loop during said off-peak operation to absorb said heat from said cooling fluid during said peak period, in said heat exchanger, and reject said heat to said cold temperature storage medium stored in said storage unit.

6. The method of claim 3, further comprising providing a heat exchanger between a source of said cooling fluid and said condenser, said heat exchanger comprising an insulated cold temperature storage medium storage chamber with pipes for said cooling fluid passing therethrough, wherein said cold temperature storage medium is generated by a chiller unit with refrigerant pumps.

7. The method of claim 1, wherein, during said off-peak operation of said power plant operating on said Rankine power cycle wherein said heat is rejected to said cooling fluid, said removing of said heat from said cold temperature storage medium is carried out using excess power available from said power plant.

8. The method of claim 1, wherein, during said off-peak operation of said power plant operating on said Rankine power cycle wherein said heat is rejected to said cooling fluid, said removing of said heat from said cold temperature storage medium is carried out using power obtained from a source external to said power plant.

9. The method of claim 1, wherein:

said cold temperature storage medium is encapsulated in a plurality of capsules provided within an insulated storage unit;

further comprising:

providing a heat exchanger between a source of said cooling fluid and said condenser, said heat exchanger being formed by said insulated storage unit and said cooling passing therethrough; and operating a refrigerant loop during said off-peak operation to freeze said cold temperature storage medium encapsulated in said plurality of capsules.

10. The method of claim 1, further comprising storing a vacuum during said off-peak operation and using said stored vacuum to aid evaporation of said cold temperature storage medium during said peak period.

11. A method comprising:

during off-peak operation of a power plant operating on a Rankine power cycle:

running said power plant at a first capacity with heat added to a working fluid of said Rankine power cycle at a high temperature, $T_H$, and rejected from said working fluid, in a condenser of said Rankine power cycle, to cooling fluid at an ambient temperature, $T_L$; and removing heat from a cold temperature storage medium so as to at least partially freeze said cold temperature storage medium;

storing said cold temperature storage medium from which said heat has been removed and which has been at least partially frozen until said power plant is experiencing a peak period; and during said peak period:

mixing said stored cold temperature storage medium with said cooling fluid at said ambient temperature $T_L$, to provide reduced temperature cooling fluid having a temperature below $T_L$;

adding heat to said working fluid of said Rankine power cycle at said high temperature, $T_H$; and rejecting heat from said working fluid of said Rankine power cycle to said reduced temperature cooling fluid in said condenser wherein said reduced temperature cooling fluid condenses said working fluid of said Rankine power cycle, thus improving thermodynamic efficiency of said Rankine power cycle, as compared to said off-peak operation, by rejecting said heat from said working fluid of said Rankine power cycle to said reduced temperature cooling fluid rather than said cooling fluid at said ambient temperature, $T_L$, said improved thermodynamic efficiency resulting in a second capacity greater than said first capacity;

wherein said cold temperature storage medium comprises water frozen into ice during said step of removing said heat from said cold temperature storage medium.

12. A method for retrofitting a power plant operating on a Rankine power cycle with an indirect cold temperature thermal energy storage system for peak conditions, said power plant having a condenser cooled by cooling fluid at an ambient temperature, $T_L$, said method comprising the steps of:

providing a cold temperature storage medium storage unit;

providing a refrigeration arrangement configured to remove heat from cold temperature storage medium stored in said cold temperature storage medium storage unit during off-peak operation of said power plant so as to at least partially freeze said cold temperature storage medium, said cold temperature storage medium storage unit storing said cold temperature storage medium from which said heat has been removed and which has been at least partially frozen until said power plant is experiencing a peak period;

providing a heat exchanger and flow control system assembly configured to cause:

during said off-peak operation, said cooling fluid to bypass said cold temperature storage medium so that said power plant runs at a first capacity with heat added to a working fluid of said Rankine power cycle at a high temperature, $T_H$, and rejected from said working fluid to said cooling fluid at said ambient temperature, $T_L$;

during said peak period operation of said power plant, said stored cold temperature storage medium from which said heat has been removed to absorb heat from said cooling fluid at said ambient temperature $T_L$, to provide reduced temperature cooling fluid having a temperature below $T_L$; and during said peak period operation:

adding heat to said working fluid of said Rankine power cycle at said high temperature, $T_H$, and rejecting heat from said working fluid of said Rankine power cycle to said reduced temperature cooling fluid in said condenser wherein said reduced temperature cooling fluid condenses said working fluid of said Rankine power cycle, thus improving thermodynamic efficiency of said Rankine power cycle, as compared to said off-peak operation, by rejecting said heat from said working fluid of said Rankine power cycle to said reduced temperature cooling fluid rather than said cooling fluid at said ambient temperature, $T_L$, said improved thermodynamic efficiency resulting in a second capacity greater than said first capacity.

13. A method for retrofitting a power plant operating on a Rankine power cycle, said power plant having a condenser cooled by cooling fluid at an ambient temperature, $T_L$, with an indirect cold temperature thermal energy storage system for peak conditions, said method comprising the steps of:

providing a cold temperature storage medium storage unit;

providing a refrigeration arrangement configured to remove heat from cold temperature storage medium stored in said cold temperature storage medium storage unit during off-peak operation of said power plant, so as to at least partially freeze said cold temperature storage medium, said cold temperature storage medium storage unit storing said cold temperature storage medium from which said heat has been removed and which has been at least partially frozen until said power plant is experiencing a peak period; and providing a mixing unit configured to cause:

during said off-peak operation, said cooling fluid to bypass said cold temperature storage medium so that said power plant runs at a first capacity with heat added to a working fluid of said Rankine power cycle at a high temperature, $T_H$, and rejected from said working fluid to said cooling fluid at said ambient temperature, $T_L$;

during said peak period operation of said power plant, said stored cold temperature storage medium from which said heat has been removed to mix with said cooling fluid at said ambient temperature $T_L$, to provide reduced temperature cooling fluid having a temperature below $T_L$;

wherein:

during said peak period operation:

adding heat to said working fluid of said Rankine power cycle at said high temperature, $T_H$; and rejecting heat from said working fluid of said Rankine power cycle to said reduced temperature cooling fluid in said condenser wherein said reduced temperature cooling fluid condenses said working fluid of said Rankine power cycle, thus improving thermodynamic efficiency of said Rankine power cycle, as compared to said off-peak operation, by rejecting said heat from said working fluid of said Rankine power cycle to said reduced temperature cooling fluid rather than said cooling fluid at said ambient temperature, $T_L$, said improved thermodynamic efficiency resulting in a second capacity greater than said first capacity; and said cold temperature storage medium comprises water frozen into ice during said removing of said heat from said cold temperature storage medium.

14. An apparatus comprising:

means for, during off-peak operation of a power plant operating on a Rankine power cycle:

running said power plant at a first capacity with heat added to a working fluid of said Rankine power cycle at a high temperature, $T_H$, and rejected from said working fluid, in a condenser of said Rankine power cycle, to cooling fluid at an ambient temperature, $T_L$; and removing heat from a cold temperature storage medium so as to at least partially freeze said cold temperature storage medium;

means for storing said cold temperature storage medium from which said heat has been removed and which has been at least partially frozen until said power plant is experiencing a peak period;

means for, during said peak period:

using said stored cold temperature storage medium to absorb heat from said cooling fluid at said ambient temperature $T_L$, to provide reduced temperature cooling fluid having a temperature below $T_L$;

adding heat to said working fluid of said Rankine power cycle at said high temperature, $T_H$; and rejecting heat from said working fluid of said Rankine power cycle to said reduced temperature cooling fluid in said condenser wherein said reduced temperature cooling fluid condenses said working fluid of said Rankine power cycle, thus improving thermodynamic efficiency of said Rankine power cycle, as compared to said off-peak operation, by rejecting said heat from said working fluid of said Rankine power cycle to said reduced temperature cooling fluid rather than said cooling fluid at said ambient temperature, $T_L$, said improved thermodynamic efficiency resulting in a second capacity greater than said first capacity.

15. An apparatus comprising:

means for, during off-peak operation of a power plant operating on a Rankine power cycle:

running said power plant at a first capacity with heat added to a working fluid of said Rankine power cycle at a high temperature, $T_H$, and rejected from said working fluid, in a condenser of said Rankine power cycle, to cooling fluid at an ambient temperature, $T_L$; and removing heat from a cold temperature storage medium so as to at least partially freeze said cold temperature storage medium;

means for storing said cold temperature storage medium from which said heat has been removed and which has been at least partially frozen until said power plant is experiencing a peak period; and means for, during said peak period:

mixing said stored cold temperature storage medium with said cooling fluid at said ambient temperature $T_L$, to lower provide reduced temperature cooling fluid having a temperature below $T_L$;

adding heat to said working fluid of said Rankine power cycle at said high temperature, $T_H$; and rejecting heat from said working fluid of said Rankine power cycle to said reduced temperature cooling fluid in said condenser wherein said reduced temperature cooling fluid condenses said working fluid of said Rankine power cycle, thus improving thermodynamic efficiency of said Rankine power cycle, as compared to said off-peak operation, by rejecting said heat from said working fluid of said Rankine power cycle to said reduced temperature cooling fluid rather than said cooling fluid at said ambient temperature, $T_L$, said improved thermodynamic efficiency resulting in a second capacity greater than said first capacity;

wherein said cold temperature storage medium comprises water frozen into ice during said step of removing said heat from said cold temperature storage medium.

16. A system comprising:

a power plant operating on Rankine power cycle, said power plant having a condenser cooled by cooling fluid at an ambient temperature, $T_L$;

a cold temperature storage medium storage unit;

a refrigeration arrangement configured to remove heat from cold temperature storage medium stored in said cold temperature storage medium storage unit during off-peak operation of said power plant so as to at least partially freeze said cold temperature storage medium, said cold temperature storage medium storage unit storing said cold temperature storage medium from which said heat has been removed and which has been at least partially frozen until said power plant is experiencing a peak period;

a heat exchanger and flow control system assembly configured to cause:

during said off-peak operation, said cooling fluid to bypass said cold temperature storage medium so that said power plant runs at a first capacity with heat added to a working fluid of said Rankine power cycle at a high temperature, $T_H$, and rejected from said working fluid to said cooling fluid at said ambient temperature, $T_L$;

during said peak period operation of said power plant, said stored cold temperature storage medium from which said heat has been removed to absorb heat from said cooling fluid at said ambient temperature $T_L$, to provide reduced temperature cooling fluid having a temperature below $T_L$;

wherein, during said peak operation, said heat is added to said working fluid of said Rankine power cycle at said high temperature, $T_H$, and heat is rejected from said working fluid of said Rankine power cycle to said reduced temperature cooling fluid in said condenser wherein said reduced temperature cooling fluid condenses said working fluid of said Rankine power cycle, thus improving thermodynamic efficiency of said Rankine power cycle, as compared to said off-peak operation, by rejecting said heat from said working fluid of said Rankine power cycle to said reduced temperature cooling fluid rather than said cooling fluid at said ambient temperature, $T_L$, said improved thermodynamic efficiency resulting in a second capacity greater than said first capacity.

17. The system of claim 16, wherein said cooling fluid comprises water from at least one of a river, a lake, and a sea.

18. The system of claim 16, wherein said cold temperature storage medium comprises water frozen into ice during said removal of said heat from said cold temperature storage medium.

19. The system of claim 18, wherein said heat exchanger comprises said cold temperature storage medium storage unit and pipes for said cooling fluid passing therethrough, wherein said refrigeration arrangement comprises a chiller unit with refrigerant pumps.

20. The system of claim 19, wherein said chiller unit is external to said cold temperature storage medium storage unit.

21. The system of claim 19, wherein said chiller unit is internal to said cold temperature storage medium storage unit.

22. The system of claim 16, wherein:

said cold temperature storage medium is encapsulated in a plurality of capsules provided within said cold temperature storage medium storage unit; and said heat exchanger comprises said cold temperature storage medium storage unit and said ambient fluid passing therethrough.

23. The system of claim 16, further comprising a vacuum chamber configured to store a vacuum during said off-peak operation and to use said stored vacuum to aid evaporation of said cold temperature storage medium during said peak period.

24. A system comprising:

a power plant operating on a Rankine power cycle, said power plant having a condenser cooled by cooling fluid at an ambient temperature, $T_L$;

a cold temperature storage medium storage unit;

a refrigeration arrangement configured to remove heat from cold temperature storage medium stored in said cold temperature storage medium storage unit during off-peak operation of said power plant, so as to at least partially freeze said cold temperature storage medium, said cold temperature storage medium storage unit storing said cold temperature storage medium from which said heat has been removed and which has been at least partially frozen until said power plant is experiencing a peak period; and a mixing unit configured to cause:

during said off-peak operation, said cooling fluid to bypass said cold temperature storage medium so that said power plant runs at a first capacity with heat added to a working fluid of said Rankine power cycle at a high temperature, $T_H$, and rejected from said working fluid to said cooling fluid at said ambient temperature, $T_L$;

during said peak period operation of said power plant, said stored cold temperature storage medium from which said heat has been removed to mix with said cooling fluid at said ambient temperature $T_L$, to provide reduced temperature cooling fluid having a temperature below TL;

wherein:

during said peak period operation, heat is added to said working fluid of said Rankine power cycle at said high temperature, $T_H$, and heat is rejected from said working fluid of said Rankine power cycle to said reduced temperature cooling fluid in said condenser wherein said reduced temperature cooling fluid condenses said working fluid of said Rankine power cycle, thus improving thermodynamic efficiency of said Rankine power cycle, as compared to said off-peak operation, by rejecting said heat from said working fluid of said Rankine power cycle to said reduced temperature cooling fluid rather than said cooling fluid at said ambient temperature, $T_L$, said improved thermodynamic efficiency resulting in a second capacity greater than said first capacity; and said cold temperature storage medium comprises water frozen into ice during said removing of said heat from said cold temperature storage medium.

* * * * *